US011814962B2

(12) United States Patent
Bonin

(10) Patent No.: US 11,814,962 B2
(45) Date of Patent: Nov. 14, 2023

(54) PISTON SEALING MECHANISM FOR A CIRCULATING PISTON ENGINE

(71) Applicant: WB Development Company LLC, Marlborough, MA (US)

(72) Inventor: Walter T. Bonin, Marlborough, MA (US)

( * ) Notice: Subject to any disclaimer, the term of this patent is extended or adjusted under 35 U.S.C. 154(b) by 0 days.

(21) Appl. No.: 17/886,929

(22) Filed: Aug. 12, 2022

(65) Prior Publication Data

US 2023/0046714 A1 Feb. 16, 2023

Related U.S. Application Data

(60) Provisional application No. 63/232,377, filed on Aug. 12, 2021.

(51) Int. Cl.

| | |
|---|---|
| ***F04C 18/324*** | (2006.01) |
| ***F01C 3/02*** | (2006.01) |
| ***F04C 23/00*** | (2006.01) |
| ***F04C 29/02*** | (2006.01) |
| ***F02B 11/00*** | (2006.01) |
| ***F02B 23/00*** | (2006.01) |
| ***F02F 5/00*** | (2006.01) |
| ***F02B 53/06*** | (2006.01) |

(Continued)

(52) U.S. Cl.

CPC ..... *F01C 19/02* (2013.01); *F01C 1/30* (2013.01); *F02B 23/00* (2013.01); *F02B 53/00* (2013.01); *F02B 53/06* (2013.01); *F02B 55/02* (2013.01); *F02F 5/00* (2013.01); *F02F 11/007* (2013.01)

(58) Field of Classification Search

CPC . F02F 11/007; F02F 5/00; F02B 23/00; F02B 53/06; F02B 55/02; F15B 15/125; F01C 19/08; F01C 3/02

See application file for complete search history.

(56) References Cited

U.S. PATENT DOCUMENTS

| | | | |
|---|---|---|---|
| 8,936,004 | B1 | 1/2015 | Buchanan |
| 2008/0050258 | A1 | 2/2008 | Wright |

(Continued)

FOREIGN PATENT DOCUMENTS

WO WO-2022262700 A1 * 12/2022 ..... F02B 53/02

OTHER PUBLICATIONS

English translation of WO202262700 by PE2E Feb. 3, 2023.*
International Search Report dated Oct. 31, 2022 From Corresponding PCT Application No. PCT/US22/040183.

*Primary Examiner* — Deming Wan
(74) *Attorney, Agent, or Firm* — Duquette Law Group LLC

(57) ABSTRACT

An engine comprises a housing and a combustion assembly carried by the housing. The combustion assembly comprises an annular bore defined by the housing, at least one combustion piston disposed within the annular bore, and a sealing mechanism configured to selectively seal the at least one combustion piston relative to at least one corresponding wall of the annular bore. The engine comprises at least one rotary valve configured to move between a first position within the annular bore to allow the at least one combustion piston to travel within the annular bore from a first location proximate to the at least one valve to a second location distal to the at least one rotary valve and a second position within the annular bore to define a combustion chamber relative to the at least one combustion piston at the second location.

19 Claims, 17 Drawing Sheets

(51) Int. Cl.

| | |
|---|---|
| ***F02B 55/02*** | (2006.01) |
| ***F01C 19/08*** | (2006.01) |
| ***F01C 19/02*** | (2006.01) |
| ***F02B 53/00*** | (2006.01) |
| ***F01C 1/30*** | (2006.01) |
| ***F02F 11/00*** | (2006.01) |

(56) References Cited

U.S. PATENT DOCUMENTS

| | | | |
|---|---|---|---|
| 2008/0202466 | A1 | 8/2008 | Webster |
| 2010/0018490 | A1 | 1/2010 | Varga |
| 2019/0242259 | A1 | 8/2019 | Bonin |

* cited by examiner

PISTON SEALING MECHANISM FOR A CIRCULATING PISTON ENGINE

RELATED APPLICATIONS

This patent application claims the benefit of U.S. Provisional Application No. 63/232,377, filed on Aug. 12, 2021, entitled "Air-Fuel Distribution Assembly for a Circulating Piston Engine," the contents and teachings of which are hereby incorporated by reference in their entirety.

BACKGROUND

Conventional piston engines include multiple cylinder assemblies used to drive a crankshaft. In order to drive the crankshaft, each cylinder assembly requires fuel, such as provided by a fuel pump via a fuel injector. During operation, a spark plug of each cylinder assembly ignites a fuel/air mixture received from the fuel injector and causes the mixture to expand. Expansion of the ignited mixture displaces a piston of the cylinder assembly within a cylinder assembly housing to rotate the crankshaft.

Rotary engines have been conceived as a potential replacement for conventional piston engines. For example, rotary engines have been described in the art as including a housing having a circular bore, one or more valves moveably mounted within the bore, and a set piston rotatably disposed within the bore and connected to a driveshaft. During operation, as the driveshaft rotates, each valve is caused to open momentarily to permit a piston to pass the valve location in the engine housing. Once the piston rotates past the valve location, the valve closes to form a combustion chamber between the valve and the piston. A fuel injector injects an air-fuel mixture into the combustion chamber and is ignited via a spark plug. The pressure in the chamber, as caused by combustion of the fuel, rotates the piston forward within the bore which, in turn, rotates the driveshaft.

SUMMARY

Conventional internal combustion piston engines suffer from a variety of deficiencies. For example, it has long been recognized that the overall operating efficiency of piston engines is relatively low. The relative inefficiency of piston engines leads to high fuel consumption and emissions which pollute the environment. Despite their recognized deficiencies, piston engine designs are still dominant in the world today.

Further in conventional piston engines, the pressure of the hot gasses created by the combustion of the air and fuel mixture contained within the cylinder can create blowby where the hot gasses and their corrosive byproducts are forced past the piston rings into the interior of the engine. As the gasses and byproducts pass into the engine, they can burn a portion of the lubricating oil contained within the cylinder, thereby adding to pollutant creation and corruption of the oil supply. As a result, conventional engines require relatively frequent oil changes. Additionally, conventional piston engines do not allow for relatively high compression ratios because of the resulting knocking/autoignition caused by the relatively long dwell times which can damage the piston and cylinder walls.

Rotary engines with their promise of high efficiency and power have never mounted a serious challenge to conventional piston engines. They too have shortcomings which have prevented them from succeeding in the marketplace.

For example, conventional rotary engine designs do not address issues regarding fueling and combustion. In order to limit the amount of energy lost to exhaust to no more than 25% during a combustion event, valve actuation, fuel and air input, and peak ignition pressure occurs in approximately ¼ of the distance to an exhaust port of the engine. However, with conventional rotary engine designs, valve operation can take up to 80% of the time available for a combustion event, which leaves relatively little time for fueling and ignition. Accordingly, relatively high pressures are typically needed to introduce the air-fuel mixture into the combustion chamber in a relatively short amount of time (e.g., under one millisecond).

By contrast to conventional fueling and combustion mechanisms, embodiments of the present innovation relate to a piston sealing mechanism for a circulating piston engine. In one arrangement, the sealing mechanism configures each combustion piston of the circulating piston engine to mitigate blowby of combustion gasses following combustion within a combustion chamber by selectively sealing the combustion piston relative to one or more of the walls of a respective annular bore. For example, the combustion piston can include a set of combustion valve channels disposed in fluid communication with a combustion fluid channel. Each combustion valve channels includes a corresponding combustion piston valve positionable between a first, retracted position, and a second, extended position. When disposed in the second position the low friction combustion valves contact the corresponding walls of the annular combustion channel of the engine. With such contact, the valves limit the flow of combustion gasses past the combustion piston.

Embodiments of the present innovation can also relate to an air-fuel distribution assembly for a circulating piston engine. In one arrangement, the air-fuel distribution assembly includes a chamber configured to direct pressurized air from a pressurized air source towards a set of fuel injectors to provide mixing of the pressurized air with fuel provided by the injectors. As the fuel and air enters the chamber, the relatively high velocity of the pressurized air creates turbulence within the chamber, thereby allowing combination of the fuel and air into an air-fuel mixture. By providing a high pressure air-fuel mixture with a high turbulence to a combustion chamber, the air-fuel distribution assembly can introduce the air-fuel mixture to the combustion chamber in a relatively short amount of time and can promote the rapid combustion of the air-fuel mixture.

In one arrangement, an engine comprises a housing and a combustion assembly carried by the housing. The combustion assembly comprises an annular bore defined by the housing, at least one combustion piston disposed within the annular bore, and a sealing mechanism configured to selectively seal the at least one combustion piston relative to at least one corresponding wall of the annular bore. The engine comprises at least one rotary valve configured to move between a first position within the annular bore to allow the at least one combustion piston to travel within the annular bore from a first location proximate to the at least one valve to a second location distal to the at least one rotary valve and a second position within the annular bore to define a combustion chamber relative to the at least one combustion piston at the second location.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Figure 1:
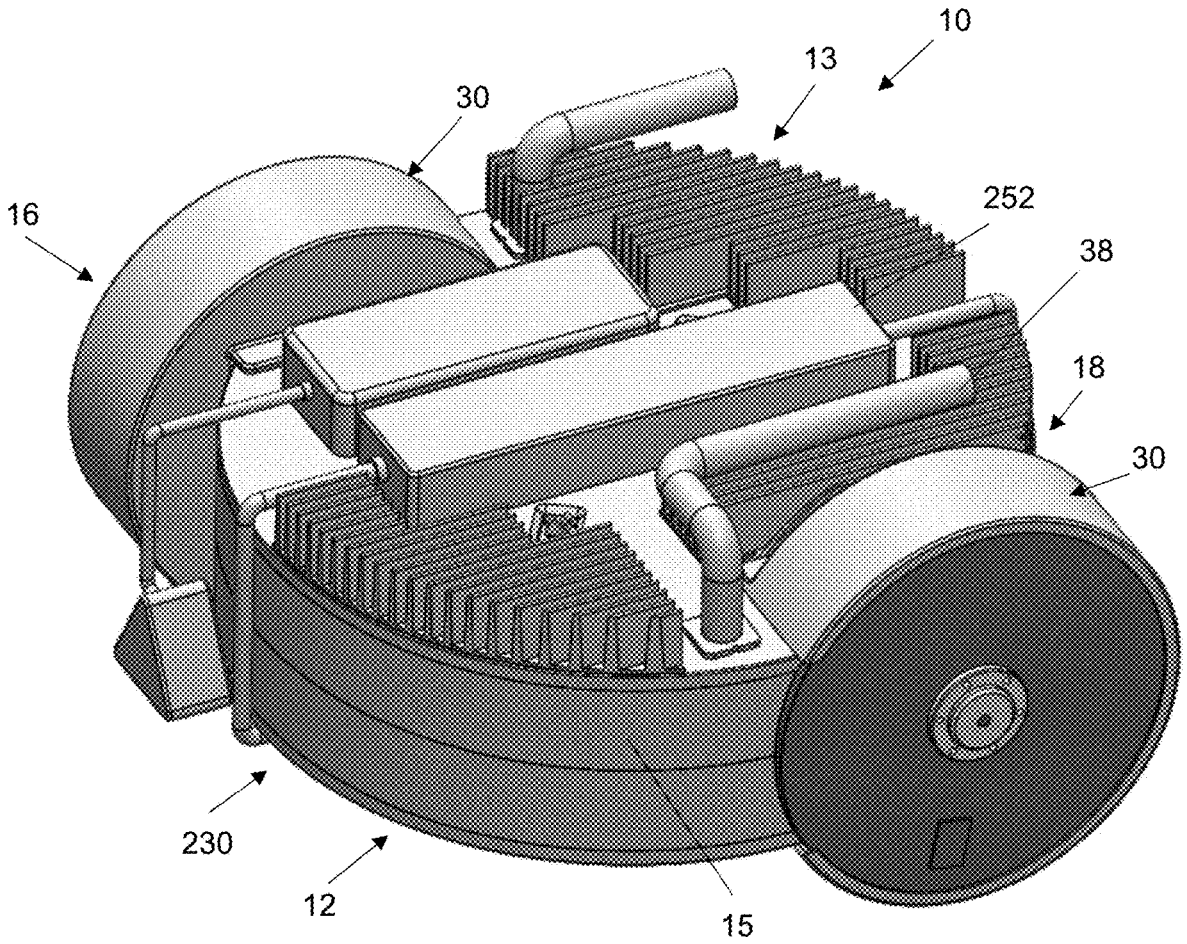
FIG. 1 illustrates a perspective view of a circulating piston engine, according to one arrangement.

Embodiments of the present innovation relate to a piston sealing mechanism for a circulating piston engine. In one arrangement, the sealing mechanism configures each combustion piston of the circulating piston engine to mitigate blowby of combustion gasses following combustion within a combustion chamber by selectively sealing the combustion piston relative to one or more of the walls of a respective annular bore. For example, the combustion piston can include a set of combustion valve channels disposed in fluid communication with a combustion fluid channel. Each combustion valve channels includes a corresponding combustion piston valve positionable between a first, retracted position, and a second, extended position. When disposed in the second position the low friction combustion valves contact the corresponding walls of the annular combustion channel of the engine. With such contact, the valves limit the flow of combustion gasses past the combustion piston.

Embodiments of the present innovation also relate to an air-fuel distribution assembly for a circulating piston engine. In one arrangement, the air-fuel distribution assembly includes a chamber configured to direct pressurized air from a pressurized air source towards a set of fuel injectors to provide mixing of the pressurized air with fuel provided by the injectors. As the fuel and air enters the chamber, the relatively high velocity of the pressurized air creates turbulence within the chamber, thereby allowing combination of the fuel and air into an air-fuel mixture. By providing a high pressure air-fuel mixture with a high turbulence to a combustion chamber, the air-fuel distribution assembly can introduce the air-fuel mixture to the combustion chamber in a relatively short amount of time and can promote the rapid combustion of the air-fuel mixture.

FIGS. 1-4 illustrate schematic views of a circulating piston engine 10, according to one arrangement. The engine 10 includes a housing 12 having cooling elements or fins 13, a combustion assembly 16 having combustion pistons 24 an air compression assembly 230 having compression pistons 240, a rotary valve assembly 18 having one or more rotary valves 30, and an air-fuel distribution assembly 400 configured to provide a mixture of fuel and air to the combustion assembly 16.

The combustion assembly 16 is configured to generate torque on a drive mechanism in response to detonation of an air-fuel mixture provided by the air-fuel distribution assembly 400. For example, with additional reference to FIG. 3, the combustion assembly 16 can include an annular channel or bore 14 defined by the engine 10 between first and second combustion housing side walls 15, 17 and between opposing first and second combustion housing plates or walls 110, 112. As illustrated, the annular bore 14 is disposed at an outer periphery of the housing 12.

While the annular bore 14 can be configured in a variety of sizes, in one arrangement, the annular bore 14 is configured as having a radius of about twelve inches relative to an axis of rotation 21 of combustion pistons 24. With such a configuration, the relatively large radius of the annular bore 14 disposes an engine combustion chamber formed within the annular bore 14 at a maximal distance from the axis of rotation 21 and allows the combustion pistons 24 to generate a relatively large torque on an associated drive mechanism, such as a drive shaft 20, disposed at an axis of rotation 21 and coupled to the combustion pistons 24.

The annular bore 14 can be configured with a cross-sectional area having a variety of shapes. For example, in the case where each combustion piston 24 defines a generally rectangular cross-sectional area, the annular bore 14 can also define a corresponding rectangular cross-sectional area. In such an arrangement, the cross-sectional area of the annular bore 14 can be relatively larger than the cross-sectional area of the combustion piston 24 to allow the combustion piston 24 to travel within the annular bore 14 during operation.

The combustion assembly 16 can include any number of individual combustion pistons 24 disposed within the annular bore 14. For example, the combustion assembly 16 can include two combustion pistons 24 disposed within the annular bore 14. While the combustion pistons 24 can be disposed at a variety of locations within the annular bore 14, in one arrangement, opposing pistons 24 are disposed at an angular orientation of about 180° relative to each other.

In one arrangement, each combustion piston 24 is coupled to, or formed integrally with, a combustion piston sealing ring 418 disposed in proximity to the second combustion housing side wall 17. The combustion piston sealing ring 418 is configured to mitigate the flow of combustion gasses created by the combustion of the air-fuel mixture past a combustion piston 24 of the combustion assembly 16 along a direction of rotation of the combustion piston 24. Returning to FIGS. 1 and 2, the air compression assembly 230 is configured to provide a source of compressed air in a process which is separate from the combustion process. For example, with additional reference to FIG. 4, the air compression assembly 230 includes an annular compression channel 242 defined by the engine 10 between first and second compression housing side walls 114, 116 and between first and second compression housing plates 118, 120. As indicated, the compression channel 242 is disposed axially below, and substantially parallel to, the combustion channel (i.e., annular bore) 14 along the axis of rotation 21.

The air compression assembly 230 includes a set of compression pistons 240 coupled to the drive shaft 20 and disposed within the annular compression channel 242. The air compression assembly 230 can include any number of individual compression pistons 240 disposed within the compression channel 242. For example, the air compression assembly 230 can include two compression pistons 240 disposed within the compression channel 242. While the compression pistons 240 can be disposed at a variety of locations within the compression channel 242, in one arrangement, opposing compression pistons 240 are disposed at an angular orientation of about 180° relative to each other.

In one arrangement, the air compression assembly 230 includes a compression piston sealing ring 419 coupled to, or formed integrally with, the compression pistons 240 and disposed in proximity to the second compression housing side wall 116. The compression piston sealing ring 419 is configured to mitigate leakage of compressed air past each piston 240 as generated by the air compression assembly 230.

Figure 5:
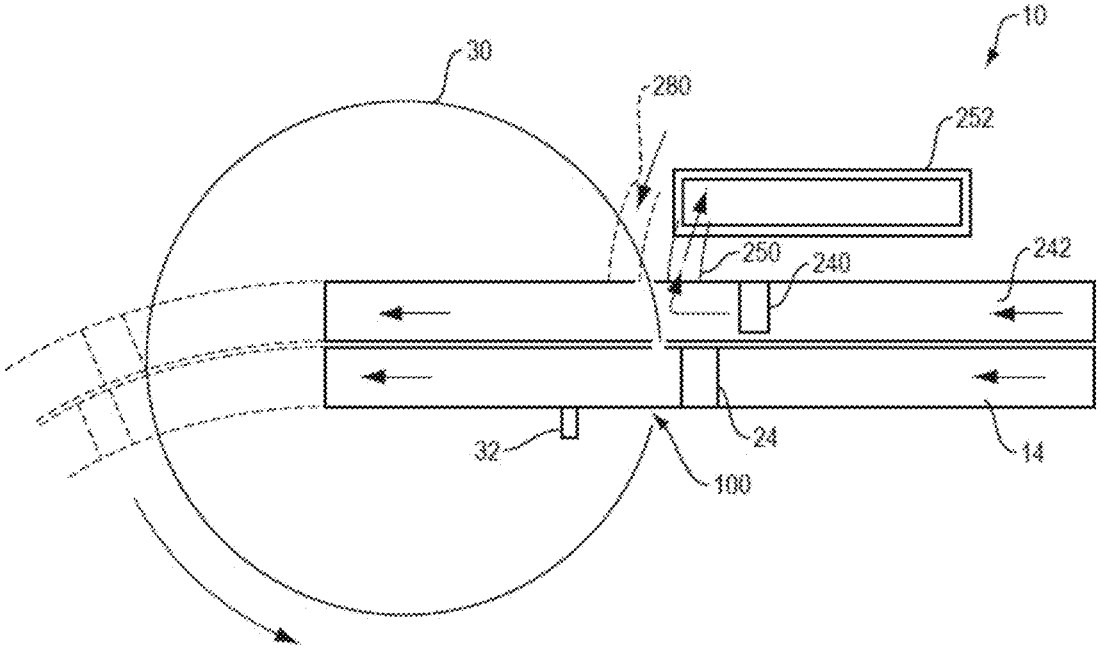
FIG. 5 illustrates a side sectional view of a portion of the circulating piston engine of FIG. 1, according to one arrangement.

The drive shaft 20 is configured to be rotated by both sets of compression pistons 240 and combustion pistons 24 within the respective channels 242, 14. Accordingly, during operation, both sets of pistons 24, 240 rotate at the same rate. As illustrated in FIG. 5, each compression piston 240 is disposed at an offset distance proximal to each respective combustion piston 24. The offset distance allows a single rotary valve 30 having a single opening 100 to serve as the rotary valve for both channels 14, 242.

As provided above, the rotary valve assembly 18 includes a set of rotary valves 30, each configured to define a combustion chamber 26 relative to the respective pistons 24 of the piston assembly 16. While the rotary valves 30 can be disposed at a variety of locations about the periphery of the housing 12, in one arrangement, opposing rotary valves 30 are disposed at an angular orientation of about 180° relative to each other.

In one arrangement, each rotary valve 30 of the rotary valve assembly 18 is manufactured as a substantially circular, cup-shaped structure. For example, with particular reference to FIG. 2, each rotary valve 30 includes loop-shaped wall structure 50 and a face plate 52. The loop-shaped wall structure 50 of the rotary valve 30 defines an opening or slot 100. The slot 100 is configured to allow each of the combustion pistons 24 to rotate within the annular bore 14 of the combustion assembly 16 when the slot 100 is aligned with a combustion piston 24 travelling in the annular bore 14. Further, the slot 100 is configured to allow each of the pistons 240 to rotate within the compression channel 242 when the slot 100 is aligned with a piston 240.

While each rotary valve 30 can be manufactured from a variety of materials, in one arrangement, the rotary valves 30 are manufactured from one or more materials capable of withstanding combustion temperatures in excess of about 4000° F. and pressures of about 1000 pounds per square inch (psi) while rotating relative to the housing 12.

In one arrangement, each rotary valve 30 is configured to rotate about an axis of rotation 56 that is substantially perpendicular to the axis of rotation 21 of the combustion pistons 24. Rotation of each rotary valve 30 relative to the housing 12 and the annular bore 14 creates a temporary combustion chamber 26 relative to a corresponding combustion piston 24.

A variety of types of rotary drive mechanisms can be utilized to rotate each rotary valve 30 within the annular bore 14. For example, with reference to FIGS. 2 and 3, the rotary drive mechanism 60 can include a drive gear 62 connected to the drive shaft 20. The rotary drive mechanism 60 can also include a set of rotary valve gears 64 disposed in operative communication with the drive gear 62 and with the rotary valves 30 via respective shafts 66. While the drive gear 62 and the set of rotary valve gears 64 can be configured in a variety of ways, in one arrangement, the drive gear 62 and each of the rotary valve gears 64 are configured as bevel gears.

With such a configuration, as the combustion pistons 24 rotate during operation, the associated drive shaft 20 and drive gear 62 also rotate. This causes the drive gear 62 to rotate each of the corresponding rotary valve gears 64, shafts 66, and rotary valves 30.

FIG. 5 illustrates an example of the operation of the engine 10.

As indicated, the combustion piston 24 and the compression piston 240 rotate in their respective channels 14, 242 while a rotary drive mechanism 60 rotates a rotary valve 30 to a first position relative to the combustion and compression channels 14, 242. With such positioning, an opening 100 of the rotary valve 30 is aligned within the combustion channel 14 such that the combustion piston 24 can travel past the rotary valve 30 from a first location proximate to the rotary valve 30, as shown, to a second location distal to the rotary valve 30. Also with such positioning, a portion of the wall structure 50 of the rotary valve 30 is disposed within the compression channel 242 to form a bulkhead relative to the compression piston 240. As the compression piston 240 rotates toward the rotary valve 30, the piston 240 compresses the air contained within the compression channel 242 between the piston 240 and the rotary valve 30 to a pressure of about 176 psi. The compressed air is delivered, via an outlet port 250, to a pressurized air reservoir 252 which is disposed in fluid communication with the compression channel 242. The pressurized air reservoir 252 maintains the pressurized air at a pressure of about 176 psi.

Continued rotation of the rotary valve 30 by the rotary drive mechanism disposes the rotary valve 30 in a subsequent or second position relative to the combustion and compression channels 14, 242 to define a combustion chamber 26 relative to the combustion piston as disposed at the second location. With such positioning, a portion of the wall structure 50 of the rotary valve 30 is disposed within the combustion channel 14 to define the combustion chamber 26. Combustion of an air-fuel mixture provided by the fuel injector 32 within the combustion chamber 26 (i.e., between the rotary valve 30 and the combustion piston 24) drives further rotation of the combustion piston 24 within combustion channel 14.

Also with such positioning of the rotary valve 30 in the second positon, the opening 100 in the rotary valve 30 becomes aligned with an inlet port 280 while the wall structure 50 of the rotary valve 30 is disposed within the compression channel 242. As the compression piston 240 travels in the compression channel 242, the wall structure 50 of the rotary valve 30 acts as a bulkhead relative to the piston 240 such that the piston 240 draws air 282 into a rearward portion of compression channel 242 via the inlet port 280. Further, rotation of the compression piston 240 compresses the air in a forward portion of the compression channel 242 against an adjacently disposed, and closed, rotary valve 30.

As provided above, in conventional piston engines, the pressure of the hot gasses created by the combustion of the air and fuel mixture contained within the cylinder can create blowby where the hot gasses and their corrosive byproducts are forced past the piston rings into the interior of the engine. In one arrangement, each of the combustion pistons 24 of the combustion assembly 16 can be configured to mitigate blowby of combustion gasses following combustion within the combustion chamber 26. For example, as shown in FIGS. 2, 3 and 6-8, the combustion piston 24 can have a sealing mechanism 500 configured to selectively seal the combustion piston 24 relative to one or more of the walls 114, 118 120 of a respective annular bore 14.

Figure 6:
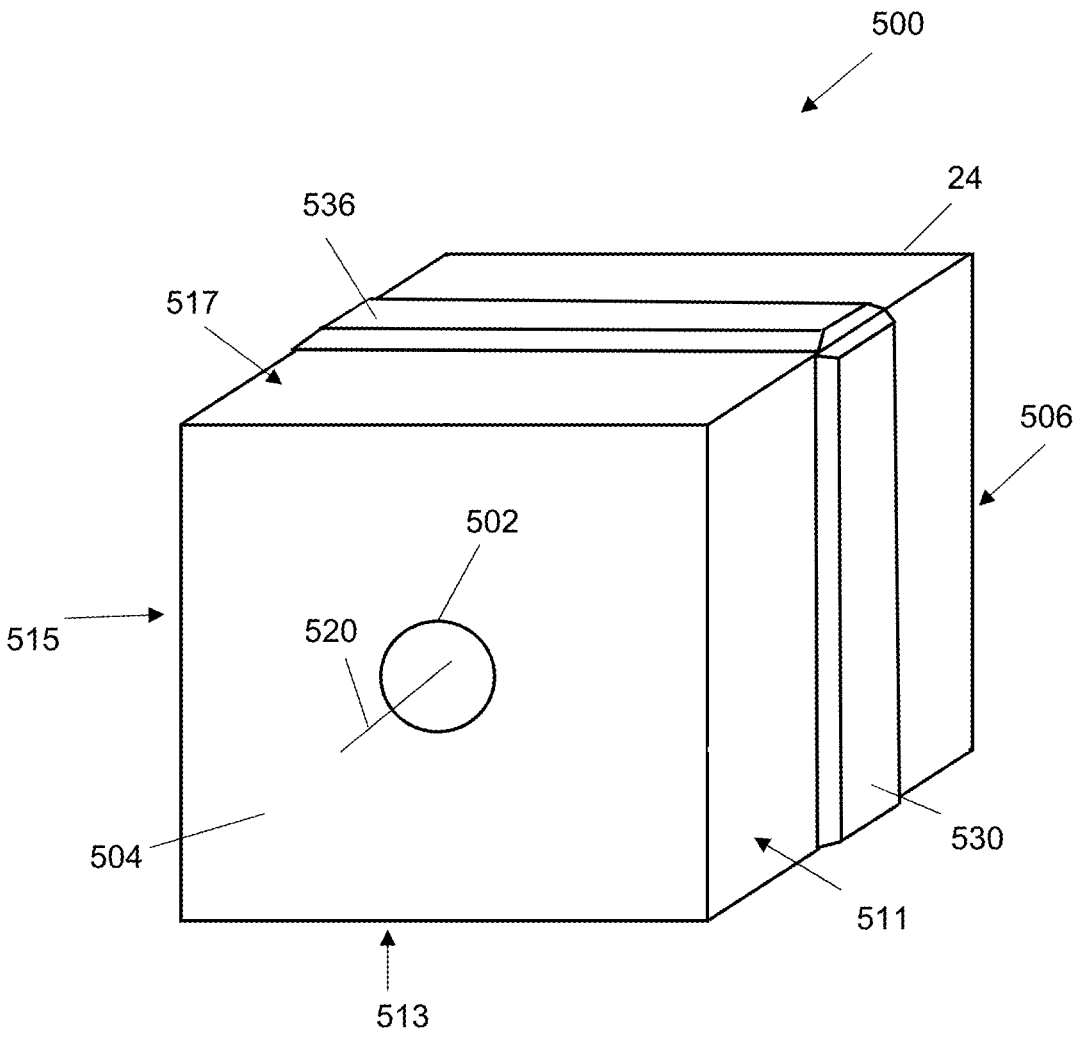
FIG. 6 illustrates a front perspective view of a combustion piston of the circulating piston engine of FIG. 1 having a piston sealing mechanism with piston valves disposed in an extended position, according to one arrangement.
Figure 7A:
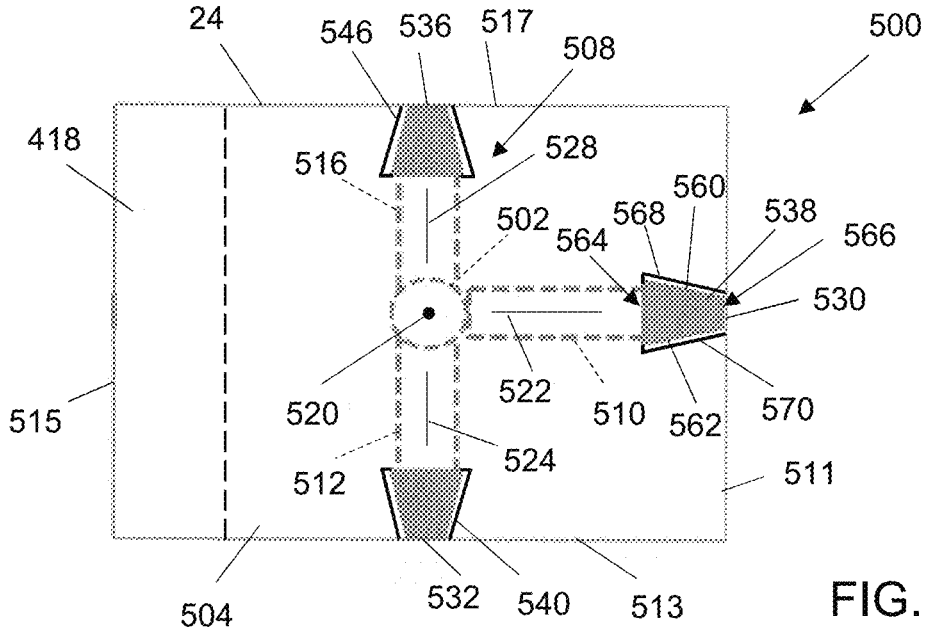
FIG. 7A illustrates a front sectional view of the combustion piston of FIG. 6, according to one arrangement.
Figure 7B:
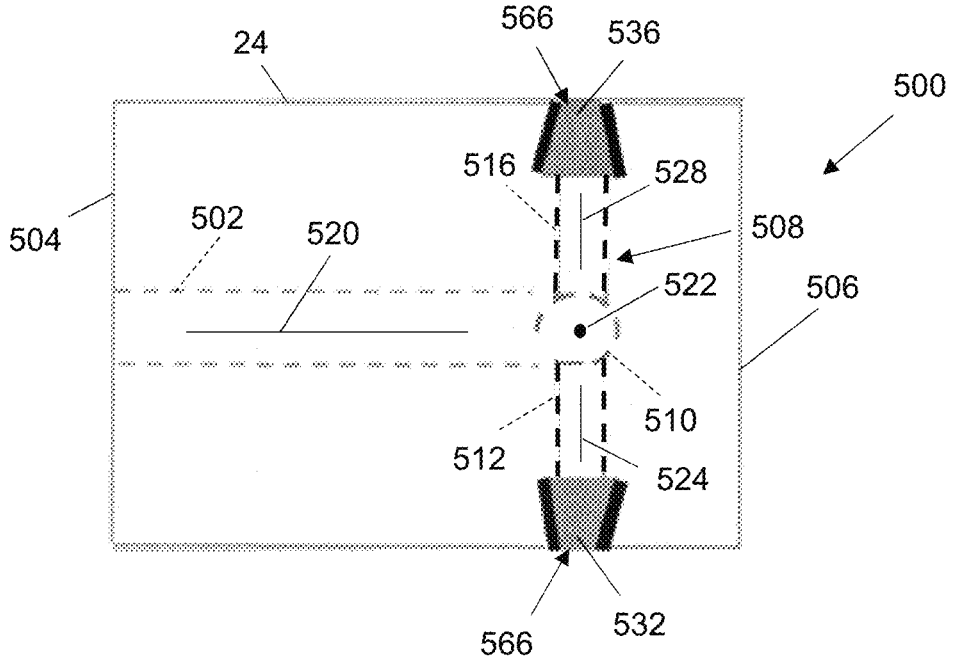
FIG. 7B illustrates side sectional view of the combustion piston of FIG. 6, according to one arrangement.
Figure 8:
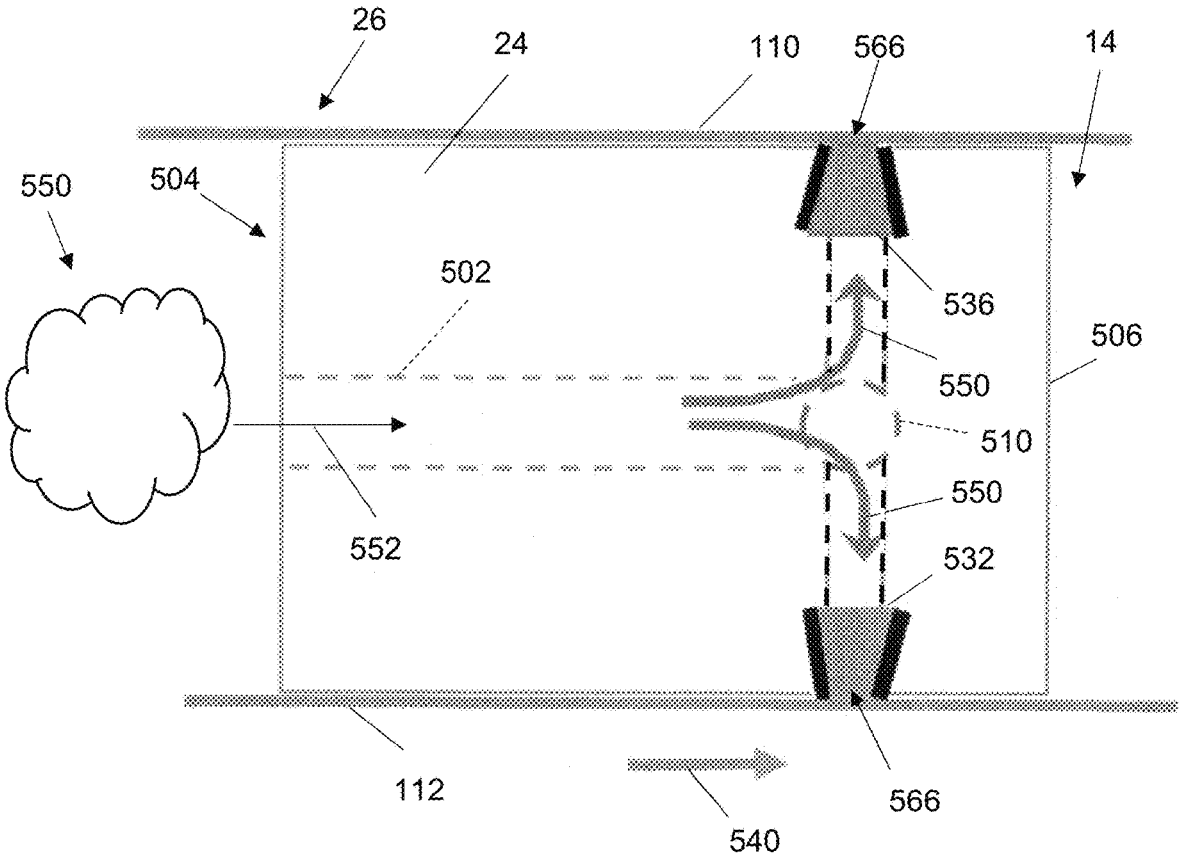
FIG. 8 illustrates operation of the combustion piston of FIGS. 7A and 7B, according to one arrangement.

In one arrangement, with particular reference to FIGS. 6-8, the sealing mechanism 500 can include a combustion fluid channel 502 defined by the combustion piston 24 extending along a longitudinal axis of the combustion piston 24 from a first or front face 504 towards an opposing second or rear face 506. The combustion fluid channel 502 is configured to collect combustion gas within the annular bore 14 defined by the housing 12 and can be defined at a substantially central location relative to the first and second faces 504, 506 of the combustion piston 24.

The combustion fluid channel 502 is further disposed in fluid communication with a set of combustion valve channels 508 defined by the combustion piston 24. For example, the set of combustion valve channels 508 can include a first combustion valve channel 510 which extends between the fluid channel 502 and a first vertical face 511 of the combustion piston 24, a second combustion valve channel 512 which extends between the fluid channel 502 and a first lateral face 513 of the combustion piston 24, and a third combustion valve channel 516 which extends between the fluid channel 502 and a second lateral face 517 of the combustion piston 24. The combustion piston sealing ring 418 can be disposed at and/or can define the second vertical face 515 of the combustion piston 24.

Each combustion valve channel 510, 512, and 516 of the set of combustion valve channels 508 can be defined by the combustion piston 24 in a variety of orientations. In one arrangement, a longitudinal axis 522, 524, and 528 of each combustion valve channel 510, 512, and 516 can be disposed at an orientation that is substantially perpendicular to a longitudinal axis 520 of the combustion fluid channel 502. Further, the longitudinal axis 522 of each the combustion valve channel 510 can be disposed at an orientation that is substantially perpendicular to the longitudinal axis 524, 528 of either adjacent valve channel 512, 516. For example, with reference to FIGS. 7A and 7B, the longitudinal axis 522 of the first combustion valve channel 510 is substantially perpendicular to both the longitudinal axis 528 of the third combustion valve channel 516 and the longitudinal axis 524 of the second combustion valve channel 512. The term "substantially," as used herein, denotes a variation of at most 5% relative to a complete perpendicularity of the longitudinal axes.

As indicated in FIGS. 6-8, each sealing mechanism 500 can also include combustion piston valves 530, 532, and 536 moveably disposed within corresponding combustion valve channels 510, 512, and 516. For example during operation, as will be described below, each combustion piston valve 530, 532, and 536 is positionable between a retracted position, as shown in FIGS. 7A and 7B, in the absence of a pressurized combustion gas within the combustion chamber 26 and an extended position, as shown in FIG. 8, in the presence of a pressurized combustion gas within the combustion chamber 26. When disposed in the extended position, each combustion piston valve 530, 532, and 536 can contact a corresponding wall 15, 110, 112 of the annular bore 14 to mitigate blowby of combustion gasses following combustion within the combustion chamber 26. For example, each combustion piston valve 530, 532, and 536 can extend along a corresponding face 511, 513, and 516 of the combustion piston 24 along a direction that is substantially perpendicular to a direction of travel 540 of the piston 24 within the annular bore 14. Such orientation allows the combustion piston valves 530, 532, and 536 seal the combustion piston 24 within the annular bore 14 and to block or limit the flow of combustion gasses in the space defined between the faces 511, 513, and 516 of the combustion piston 24 and the walls 15, 112, 110 annular bore 14.

In one arrangement, the relative geometries of the combustion piston valves 530, 532, and 536 and the combustion valve channel 510, 512, and 516 can limit the extension of the combustion piston valves 530, 532, and 536 relative to the faces 511, 513, and 517 of the combustion piston 24 when disposed in the extended position. For example, as shown in FIGS. 7A and 7B, each combustion piston valve 530, 532, and 536 is carried within a corresponding slot 538, 540, and 546 defined by the corresponding combustion valve channel 510, 512, and 516 of the combustion piston 24. Each piston valve 530, 532, and 536 includes a first sidewall 560 and a second side wall 562 which defines a tapered geometry from a first end 564 of the combustion piston valve 530, 532, and 536 toward a second end 566 of the combustion piston valve 530, 532, and 536.

Further, each slot 538, 540, and 546 defined by the corresponding valve channel can have angled sides configured to mate with the correspondingly angled combustion piston valves 530, 532, and 536. For example, each slot 538, 540, and 546 includes a first angled sidewall 568 and a second angled sidewall 570. During operation, when each combustion piston valve 530, 532, and 536 translates to an extended position, the first sidewall 550 and a second side wall 553 of each combustion piston valve 530, 532, and 536 engage the corresponding first angled sidewall 568 and second angled sidewall 570 of each corresponding slot 538, 540, and 546. With such engagement, a portion of the second end 566 of each combustion piston valve 530, 532, and 536 can extend past the corresponding vertical face 513, 517 and lateral face 511 of the combustion piston 24. With such positioning, interaction of the first and second angled sidewalls 568, 570 with the first and second sidewalls 560, 562 of the combustion piston 24 allows the combustion piston valve 530, 532, and 536 to contact the corresponding walls 15, 110, 112 of the annular bore 14 while securing the piston valve 530, 532, and 536 within the combustion piston 24 in the extended position.

The combustion piston valves 530, 532, and 536 can be manufactured from a variety of materials to mitigate or limit friction between the combustion piston 24 and the corresponding walls 15, 110, and 112 of the annular bore 14 when in contact with the walls 15, 110, and 112 of the annular channel or bore 14. For example, each combustion piston valve 530, 532, and 536 can be manufactured from a barium bronze material. In another example, each piston valve 530, 532, and 536 can be manufactured from, or coated with, a TEFLON or other low friction material.

During operation, each combustion piston valve 530, 532, and 536 can be positioned between a first, retracted position, and a second, extended position. For example, prior to the combustion of an air-fuel mixture within a combustion chamber 26, each combustion piston valve 530, 532, and 536 can be disposed in the first, retracted position, as shown in FIGS. 7A and 7B, such that the second end 566 of each combustion piston valve 530, 532, and 536 is disposed at a distance away from a corresponding wall 15, 110, and 112 of the annular bore 14. For example, each face 511, 513, and 517 of the combustion piston 24 can define a lateral clearance space relative to the corresponding wall 15, 110, and 112 of the annular bore 14 of between about 0.001 and 0.0015 inches. In one arrangement, when disposed in the first, retracted position, the second end (i.e., the wall contact face) 566 of each combustion piston valve 530, 532, and 536 can define a lateral clearance space of between about 0.001 and 0.0015 inches relative to the corresponding wall 15, 110, and 112 of the annular bore 14.

Further, with reference FIG. 8, following combustion of an air-fuel mixture within a combustion chamber 26, the combustion causes the combustion piston 24 to move along direction 540 within the annular bore 14. Further, the combustion gas 550 generated by the detonation of the air-fuel mixture travels along direction 552 at a rate that is greater than the rate of travel of the combustion piston 24. As such, the pressurized combustion gas 550 can enter the combustion fluid channel 502 defined by the combustion piston 24 and can flow through each of the combustion valve channel 510, 512, and 516 to push the corresponding combustion piston valve 530, 532, and 536 against the corresponding slot 538, 540, and 546 to an extended position. When disposed in the extended position, the second end (i.e., the wall contact face) 566 of each combustion piston valve 530, 532, and 536 can contact the corresponding wall 15, 110, and 112 of the annular bore 14. Such contact can mitigate blowby of the combustion gas relative to the combustion piston 24. Further, the presence of the combustion piston sealing ring 418 can also mitigate the flow of combustion gas past the combustion piston 24 along the direction of rotation of the combustion piston 24.

As the combustion piston 24 travels within the annular bore 26, the pressure of the combustion gas 550 decreases within the combustion chamber 26. Such a reduction in pressure reduces the pressure within the combustion fluid channel 502 and causes the combustion piston valves 530, 532, and 536 to move between the extended position, where the second end 566 of each combustion piston valve 530, 532, and 536 contact the corresponding walls 15, 110, and 112, to a retracted position within the combustion valve channel 510, 512, and 516. With such positioning of the combustion piston valves 530, 532, and 536, the combustion piston 24 can rotate within the annular bore 14 with negligible, if any, friction generated between the combustion piston 24 and the walls 15, 110, and 112 of the annular bore 14.

As provided above, the sealing mechanism 500 is utilized as part of a combustion piston 24. It should be understood that the sealing mechanism 500 can be used as part of a compression piston 240 as well.

Figure 9A:
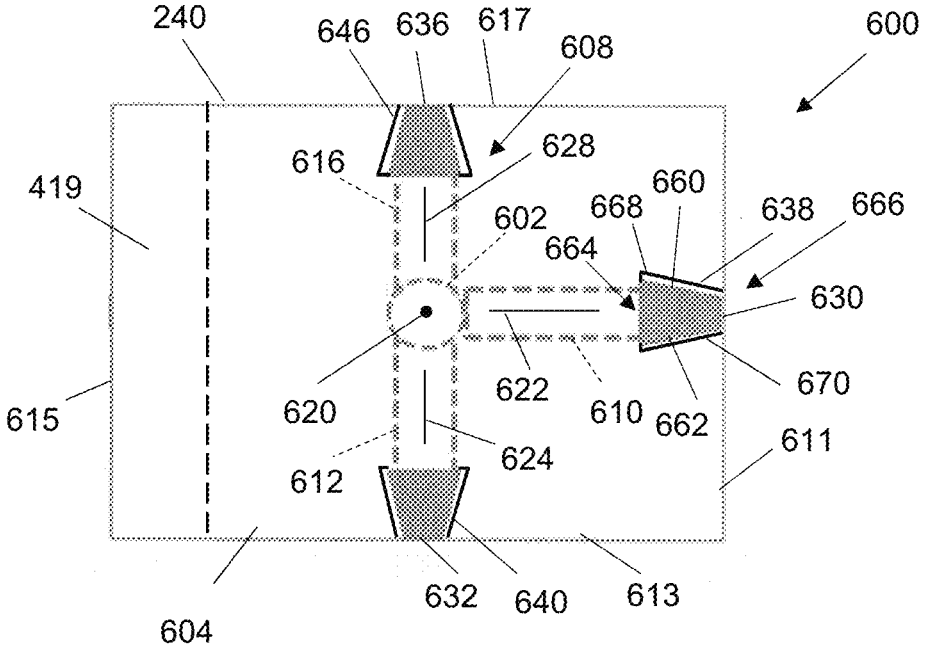
FIG. 9A illustrates a front sectional view of a compression piston of the circulating piston engine of FIG. 1 having a piston sealing mechanism, according to one arrangement

For example, as illustrated in FIG. 9A, the compression piston 240 can include a sealing mechanism 600 configured to selectively seal the compression piston 600 relative to the annular compression channel 242. The sealing mechanism 600 defines a compression fluid channel 602 extending along a longitudinal axis 620 of the compression piston 240 from a second or rear face 606 towards an opposing first or front face 604 and is configured to collect pressurized gas within the annular compression channel 242 defined by the housing 12. The fluid channel 602 is further disposed in fluid communication with a set of compression valve channels 608 which include first 610, second 612, and third 616 compression valve channels. The first compression valve channel 510 extends between the compression fluid channel 602 and a first vertical face 611 of the compression piston 240, the second compression valve channel 612 extends between the compression fluid channel 602 and a first lateral face 613 of the compression piston 240, and the third compression valve channel 616 extends between the compression fluid channel 602 and the second lateral face 717 of the compression piston 240. The compression piston sealing ring 419 can be disposed at and/or can define the second vertical face 615 of the compression piston 240.

Each compression valve channel 610, 612, and 616 of the set of compression valve channels 608 can be defined by the compression piston 240 in a variety of orientations. In one arrangement, a longitudinal axis 622, 624, and 628 of each compression valve channel 610, 612, and 616 can be disposed at an orientation that is substantially perpendicular to a longitudinal axis 620 of the compression fluid channel 602. Further, the longitudinal axis 622 of each the compression valve channel 610 can be disposed at an orientation that is substantially perpendicular to the longitudinal axis 624, 628 of either adjacent valve channel 612, 616. For example, with reference to FIG. 9A, the longitudinal axis 622 of the first compression valve channel 610 is substantially perpendicular to both the longitudinal axis 628 of the third compression valve channel 616 and the longitudinal axis 624 of the second compression valve channel 612.

Figure 9B:
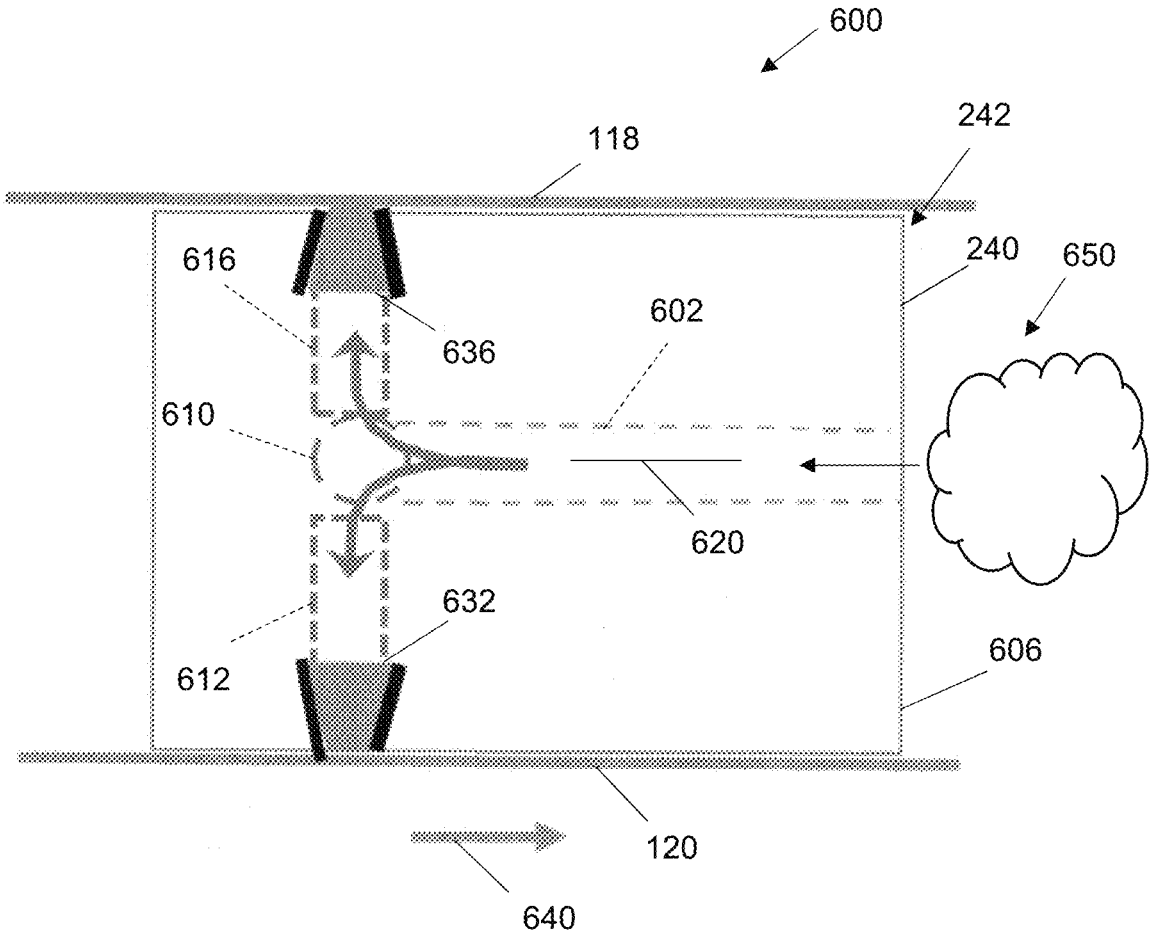
FIG. 9B illustrates operation of the compression piston of FIG. 9A, according to one arrangement.

The sealing mechanism 600 also includes compression piston valves 630, 632, and 636 moveably disposed within corresponding compression valve channels 610, 612, and 616. For example during operation, as will be described below, each compression piston valve 630, 532, and 636 is positionable between a retracted position, as shown in FIG. 9A, in the absence of a pressurized gas within the annular compression channel 242 and an extended position, as shown in FIG. 9B, in the presence of a pressurized gas within the annular compression channel 242. When disposed in the extended position, each compression piston valve 630, 632, and 636 can contact a corresponding wall 114, 118, 120 of the annular compression channel 242 to mitigate the leakage of pressurized gasses in a direction opposing a direction of travel of the compression piston 240. For example, each compression piston valves 630, 632, and 636 can extend along a corresponding face 611, 613, and 616 of the compression piston 240 along a direction that is substantially perpendicular to a direction of travel 640 of the piston 240 within the annular bore 14. Such orientation allows the compression piston valves 630, 632, and 636 seal the compression piston 240 within the annular compression channel 242 and to block or limit the flow of pressurizes air in the space defined between the faces 611, 613, and 616 of the compression piston 240 and the wall 114, 118, 120 of the annular compression channel 242.

In one arrangement, the relative geometries of the compression piston valves 630, 632, and 636 and the compression valve channel 610, 612, and 616 can limit the extension of the compression piston valves 630, 632, and 636 relative to the faces 611, 613, and 617 of the compression piston 240 when disposed in the extended position. For example, as shown in FIG. 9A, each compression piston valve 630, 632, and 636 is carried within a corresponding slot 638, 640, and 646 defined by the corresponding compression valve channel 610, 612, and 616 of the compression piston 240. Each piston valve 630, 632, and 636 includes a first sidewall 660 and a second side wall 662 which defines a tapered geometry from a first end 664 of the compression piston valve 630, 632, and 636 toward a second end 666 of the compression piston valve 530, 632, and 636.

Further, each slot 638, 640, and 646 defined by the corresponding compression valve channel can have angled sides configured to mate with the correspondingly angled compression piston valves 630, 632, and 636. For example, each slot 638, 640, and 646 includes a first angled sidewall 668 and a second angled sidewall 670. During operation, when each compression piston valve 630, 632, and 636 translates within a corresponding compression valve channel to an extended position, a first sidewall 650 and a second side wall 653 of each compression valve channel piston valve 630, 632, and 636 engage the corresponding first angled sidewall 668 and second angled sidewall 670 of each corresponding slot 638, 640, and 646. With such engagement, a portion of the second end 666 of each compression valve channel piston valve 630, 632, and 636 can extend past the corresponding vertical face 613, 617 and lateral face 611 of the compression piston 240. With such positioning, interaction of the first and second angled sidewalls 668, 670 with the first and second sidewalls 660, 662 of the compression piston 240 allows each compression piston valve 630, 632, and 636 to contact the corresponding walls 114, 118, 120 of the annular compression channel 242 while securing the compression piston valve 630, 632, and 636 within the compression piston 240 in the extended position.

The compression piston valves 630, 632, and 636 can be manufactured from a variety of materials to mitigate or limit friction between the compression piston 240 and the corresponding walls 114, 118, and 120 of the annular compression channel 242. For example, each compression piston valve 630, 632, and 636 can be manufactured from a barium bronze material. In another example, each compression piston valve 630, 632, and 636 can be manufactured from, or coated with, a TEFLON or other low friction material.

During operation, as the compression piston 240 travels along direction 640, the motion of the compression piston 240 directs compressed air 650 to enter the compression fluid channel 602. As such, the compressed air 650 can flow through each of the compression valve channels 610, 612, and 616 to dispose each compression piston valve 630, 632, and 636 from first, retracted position, as shown in FIG. 9A, where the second end 566 of each compression piston valve 630, 632, and 636 is disposed at a distance away from a corresponding walls 114, 118, and 120 of the annular compression channel 242, to a second, extended positon, as shown in FIG. 9B. When disposed in the extended position, the second end (i.e., the wall contact face) 566 of each compression piston valve 630, 632, and 636 can contact the corresponding walls 114, 118, and 120 of the annular compression channel 242. Such contact can mitigate leakage of the pressurized gas past to the compression piston 240. Further, the presence of the compression piston sealing ring 419 can also mitigate the flow of the pressurized gas (e.g., compressed air) past the compression piston 240 along a direction opposite to the direction of rotation 640 of the compressed air relative to the compression piston 240.

As the compression piston 240 travels within the annular compression channel 242, the gas pressure within the annular compression channel 242 can decreases. Such a reduction in pressure reduces the pressure within the compression fluid channel 602 and causes the compression piston valves 630, 632, and 636 to move between the extended position, where the second end 666 of each compression piston valve 630, 632, and 636 contact the corresponding walls 114, 118, and 120 of the annular compression channel 242, to a retracted position within the compression valve channel 610, 612, and 616. With such positioning of the compression piston valves 630, 632, and 636, the compression piston 240 can rotate within the compression channel 242 with negligible, if any, friction generated between the compression piston 240 and the walls 114, 118, and 120.

As provided above, the sealing assembly 500 for the combustion piston 24 can include three combustion valve channels 510, 512, and 516 having corresponding combustion piston valves 530, 532, and 536 and a sealing ring 418. In one arrangement, in place of the sealing ring 418 the sealing assembly 500 can include a fourth combustion channel and combustion piston valve to mitigate blowby relative to the wall 17 of the annular bore 14.

Figure 10A:
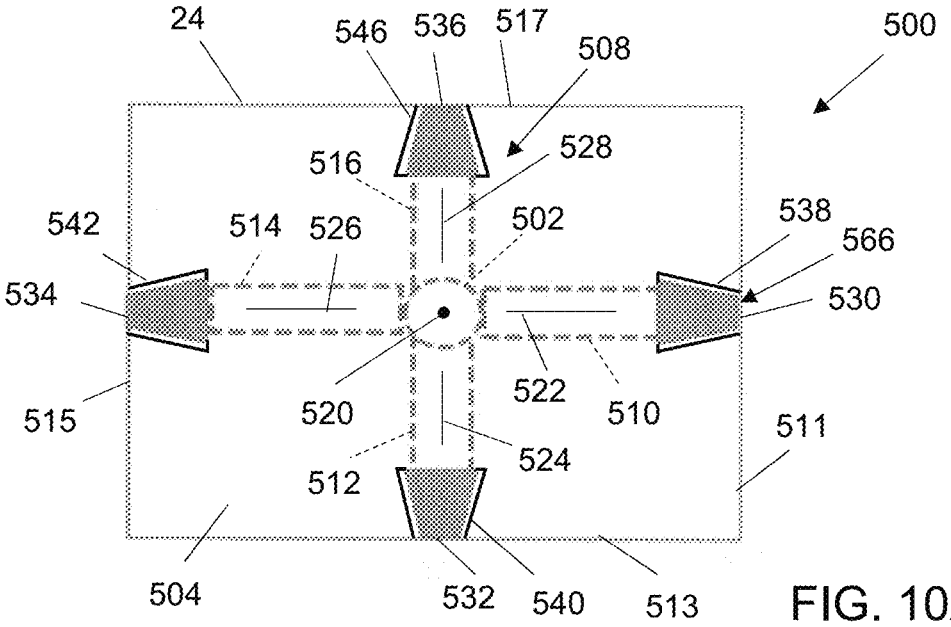
FIG. 10A illustrates a front sectional view of a combustion piston of the circulating piston engine of FIG. 1 having a piston sealing mechanism, according to one arrangement.

For example, with reference to FIG. 10A, the sealing assembly 500 includes the combustion fluid channel 502 as being disposed in fluid communication with a fourth combustion valve channel 514 which extends between the fluid channel 502 and a second vertical face 515 of the combustion piston 24. The sealing mechanism 500 also includes a fourth combustion valve 530 disposed within a slot 542 of the combustion valve channel 514. The fourth combustion valve is positionable between a retracted and extended position relative to the vertical face 515 of the combustion piston 24, such as described above with respect to the combustion valves 530, 532, 536.

Also as provided above, the sealing assembly 600 for the compression piston 240 can include three compression valve channels 610, 612, and 616 having corresponding compression piston valves 630, 632, and 636 and a sealing ring 419. In one arrangement, in place of the sealing ring 419, the sealing assembly 600 can include a fourth compression channel and compression piston valve to mitigate leakage of pressurized air relative to the wall 116 of the annular compression channel 242.

Figure 10B:
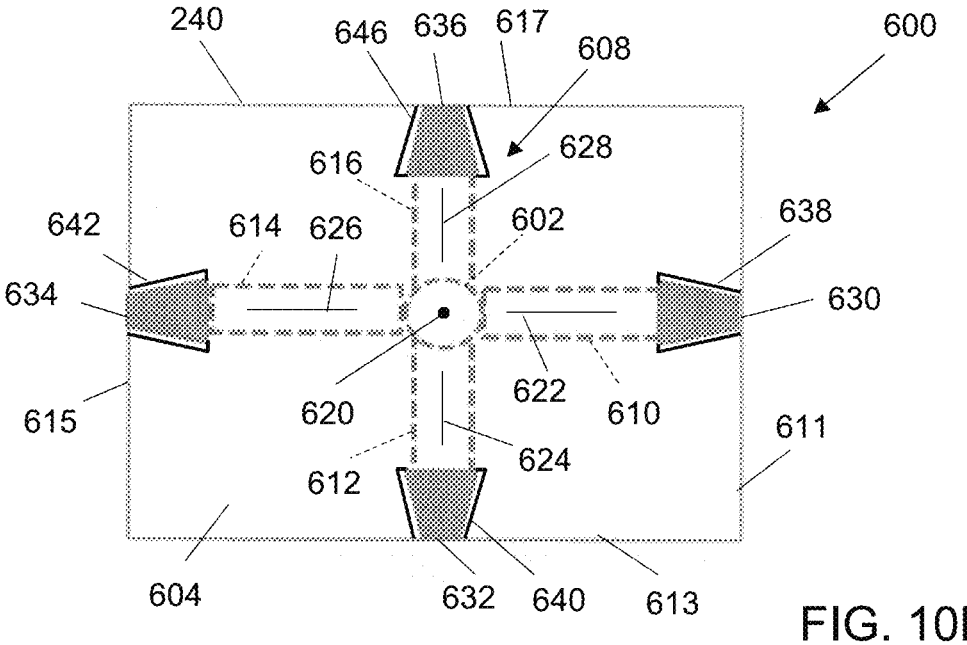
FIG. 10B illustrates a front sectional view of a compression piston of the circulating piston engine of FIG. 1 having a piston sealing mechanism, according to one arrangement.

For example, with reference to FIG. 10B, the sealing assembly 600 includes the compression fluid channel 602 as being disposed in fluid communication with a fourth compression valve channel 614 which extends between the fluid channel 602 and a second vertical face 615 of the c compression piston 240. The sealing mechanism 500 also includes a fourth compression valve 630 disposed within a slot 642 of the compression valve channel 514. The fourth compression valve 630 is positionable between a retracted and extended position relative to the vertical face 615 of the compression piston 240, such as described above with respect to the compression valves 630, 632, 636.

Figure 11:
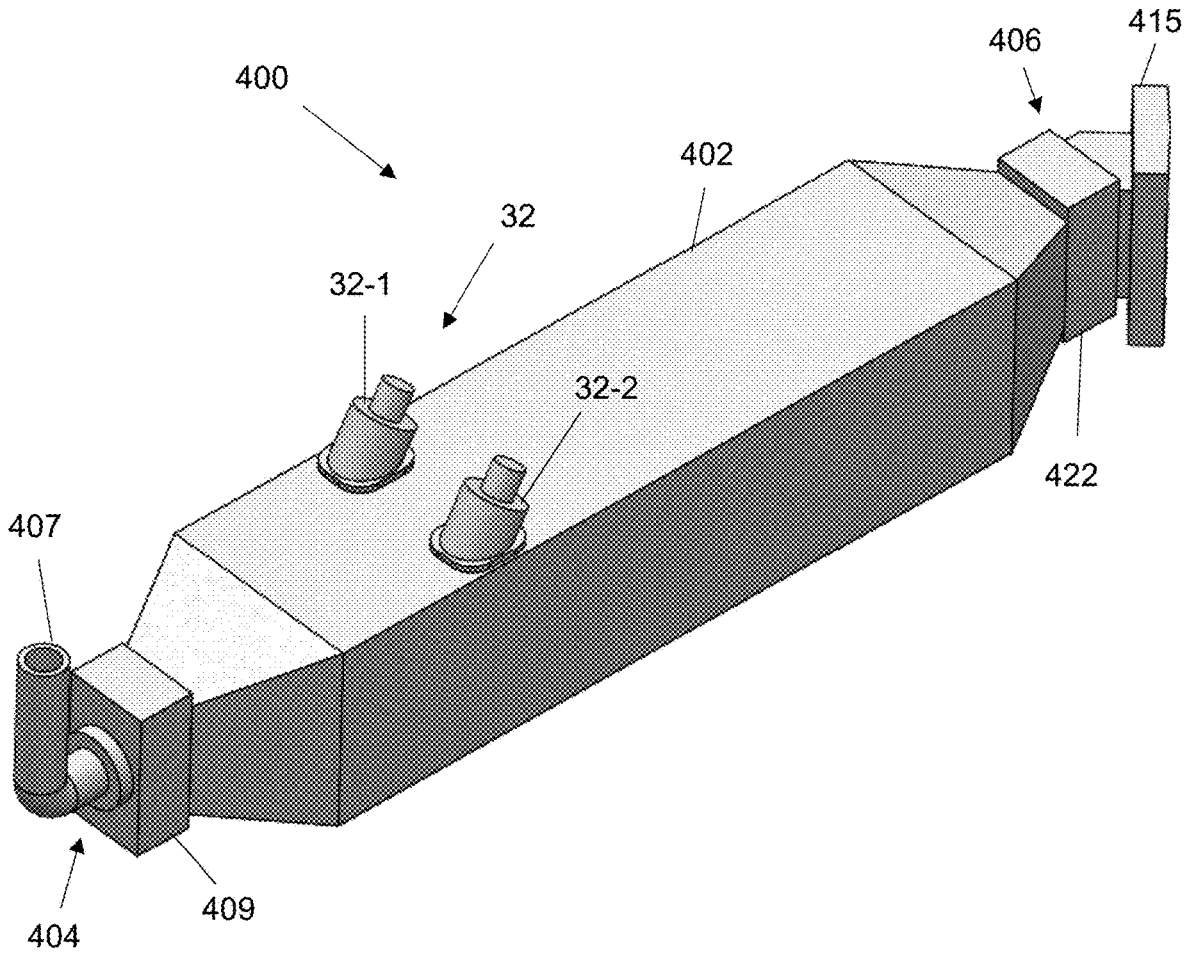
FIG. 11 illustrates a perspective view of a fuel distribution assembly of the engine of FIG. 1, according to one arrangement.
Figure 12:
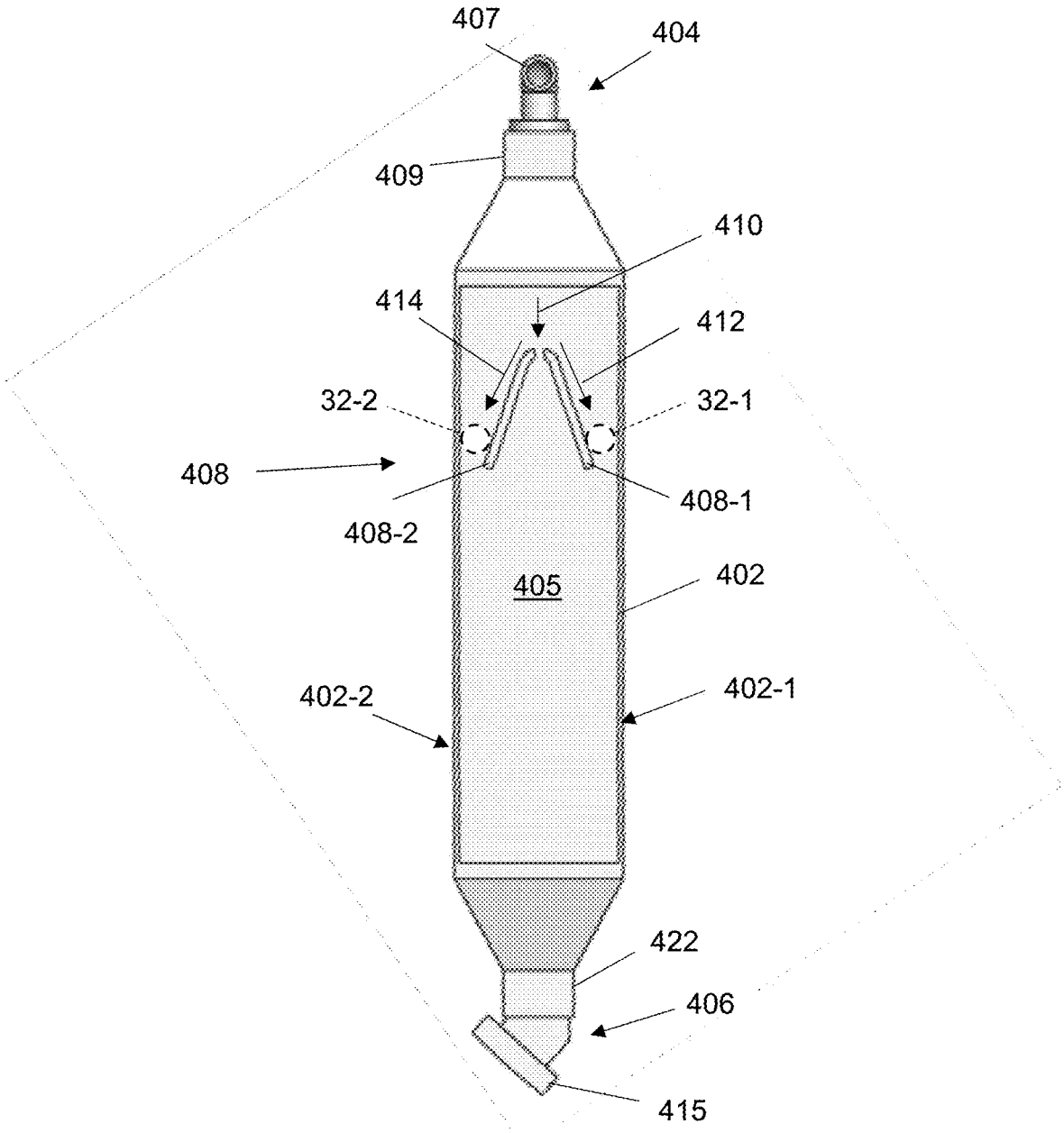
FIG. 12 illustrates a top sectional view of the fuel distribution assembly of FIG. 11, according to one arrangement.

As indicated above, the engine 10 can include an air-fuel distribution assembly 400 configured to mix fuel from a fuel source and air from an air source into an air-fuel mixture at a location external to the combustion chamber 26 and to provide the air-fuel mixture to the combustion chamber 26. For example, with reference to FIGS. 3, 11 and 12, the air-fuel distribution assembly 400 includes a housing 402 having an inlet port 404 and an outlet port 406 and defines a chamber 405 disposed there between.

The inlet port 404 is disposed in fluid communication with the pressurized air reservoir 252 via a conduit 407 and the outlet port 406 is disposed in fluid communication with the combustion chamber 26. In one arrangement, the air-fuel distribution assembly 400 includes a flow control device 409 disposed in fluid communication between the conduit 407 and the housing 402 which can be configured to meter the flow of pressurized air provided to the chamber 405. For example, the flow control device 409 can be an on/off valve which selectively provides pressurized air from the conduit 407 to the chamber 405.

The air-fuel distribution assembly 400 can include a laminar flow device 408 disposed coupled to the housing 402 in proximity to the inlet port 404. The laminar flow device 408 can be configured to control one or more of the distribution, shape, and/or velocity of the pressurized air provided to the chamber 405 through the inlet port 404. While the laminar flow device 408 can be configured in a variety of ways, in one arrangement, the laminar flow device 408 is configured as a set of baffle elements, such as first and second baffle elements 408-1, 408-2. As shown, each baffle element 408-1, 408-2 includes a rounded portion disposed in proximity to the inlet port 404 and an elongated portion angled toward corresponding sidewalls 402-1, 402-2. The rounded portions can assist with guiding pressurized air 410 into the chamber 405 while the angled elongated portions can increase the velocity of the pressurized air as it passes into the chamber 405. While two baffle elements 408-1, 408-2 are illustrated, it should be understood that the laminar flow device 408 can include any number of baffle elements.

The air-fuel distribution assembly 400 can include a set of fuel injectors 32, such as fuel injectors 32-1, 32-2, coupled to the housing 12 and disposed in proximity to the laminar flow device 408. In one arrangement, the fuel injectors 32-1, 32-2 are configured to provide fuel to the air-fuel distribution assembly 400 in a substantially continuous manner, such as while the engine 10 is running.

The outlet port 406 is disposed in selective fluid communication with the combustion chamber 26 defined between each rotary valve 30 and combustion piston 24. For example, the outlet port 406 includes a mounting element 415 configured to be coupled to the second housing wall 17 of the engine 10 in proximity to an opening 420 defined by the second housing wall 17. As will be described below, the combustion piston 24 can selectively align an opening 416 of an associated combustion piston sealing ring 418 with the opening 420 the second housing wall 17 to provide or prevent an air-fuel mixture access to a combustion chamber 26 of the engine 10.

The air-fuel distribution assembly 400 can include an air-fuel volume control device 422 disposed in fluid communication between the chamber 405 and the outlet port 406. In one arrangement, the air-fuel volume control device 422 is configured to meter distribution of the air-fuel mixture contained within the chamber 405 to the outlet port 406. With such metering, the air-fuel volume control device 422 can adjust the pressure of the air-fuel mixture to about 176 psi as it enters the combustion chamber 26 from the outlet port 406.

During operation, the air-fuel distribution assembly 400 is configured to direct pressurized air from the inlet port 402 towards the set of fuel injectors 32 to provide mixing of the pressurized air with fuel provided by the injectors 32. For example, pressurized air can enter the air-fuel distribution assembly 400 from the inlet port 404 at 176 PSI/2600 mph (3.35 inches/millisecond) along direction 410. The baffle elements 408-2, 408-2 split the path 410 of the pressurized air along directions 412, 414 toward the fuel injectors 32-1, 32-2 which provide fuel into the respective pressurized air paths.

Figure 3:
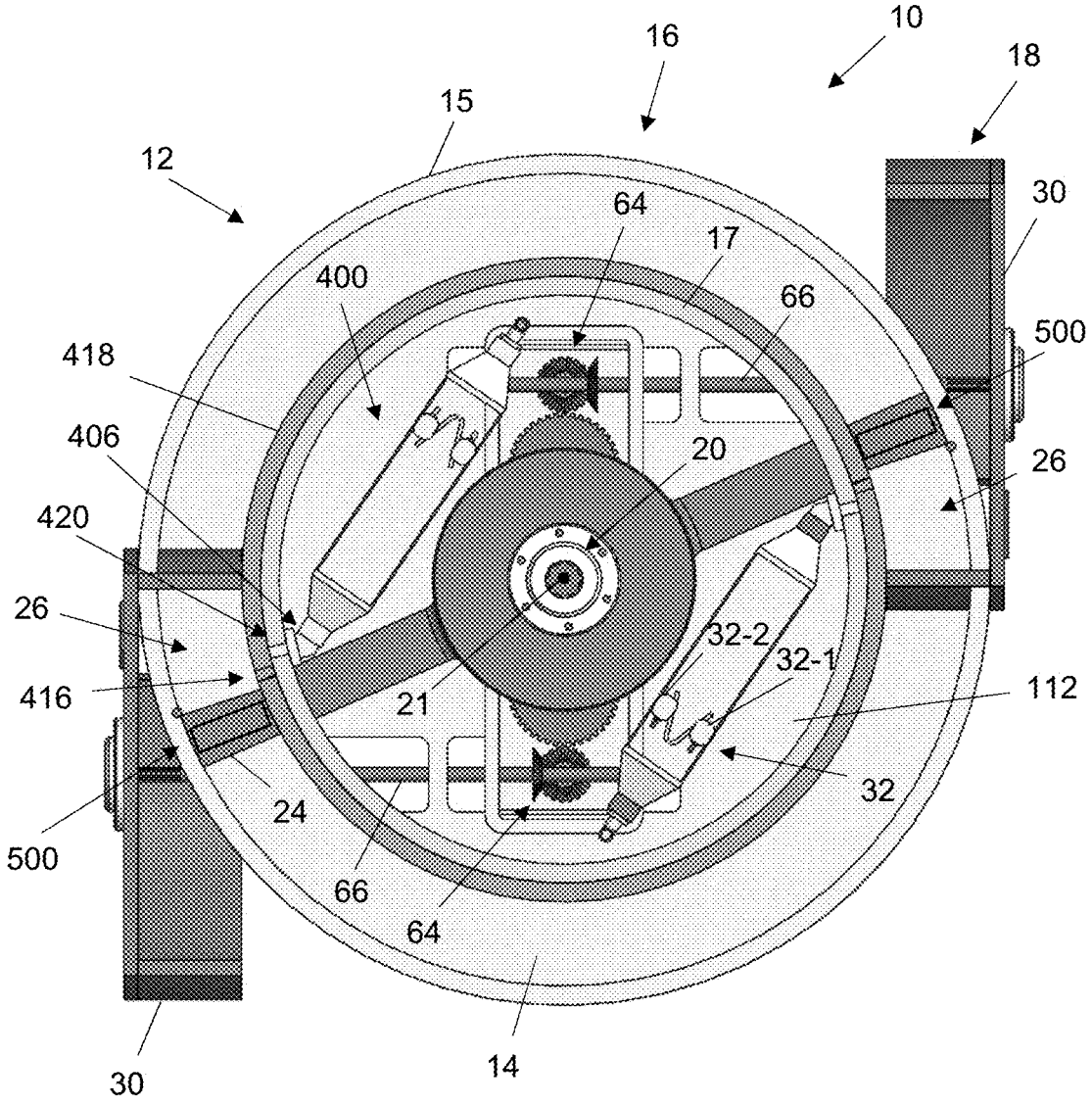
FIG. 3 illustrates a top sectional view of the circulating piston engine of FIG. 1, according to one arrangement.

As the fuel and air enter the chamber 405, the relatively high velocity of the pressurized air can create turbulence within the chamber 405, thereby allowing combination of the fuel and air into an air-fuel mixture. With reference to FIG. 3, the air-fuel mixture exits the outlet port 406 and can enter a combustion chamber 26 when an opening 416 of a combustion piston sealing ring 418 becomes aligned with an opening 420 of the second housing wall 17 of the engine 10. Accordingly, by providing a high pressure air-fuel mixture with a high turbulence to the combustion chamber 26, the air-fuel distribution assembly 400 promotes the rapid combustion of the air-fuel mixture.

Figure 2:
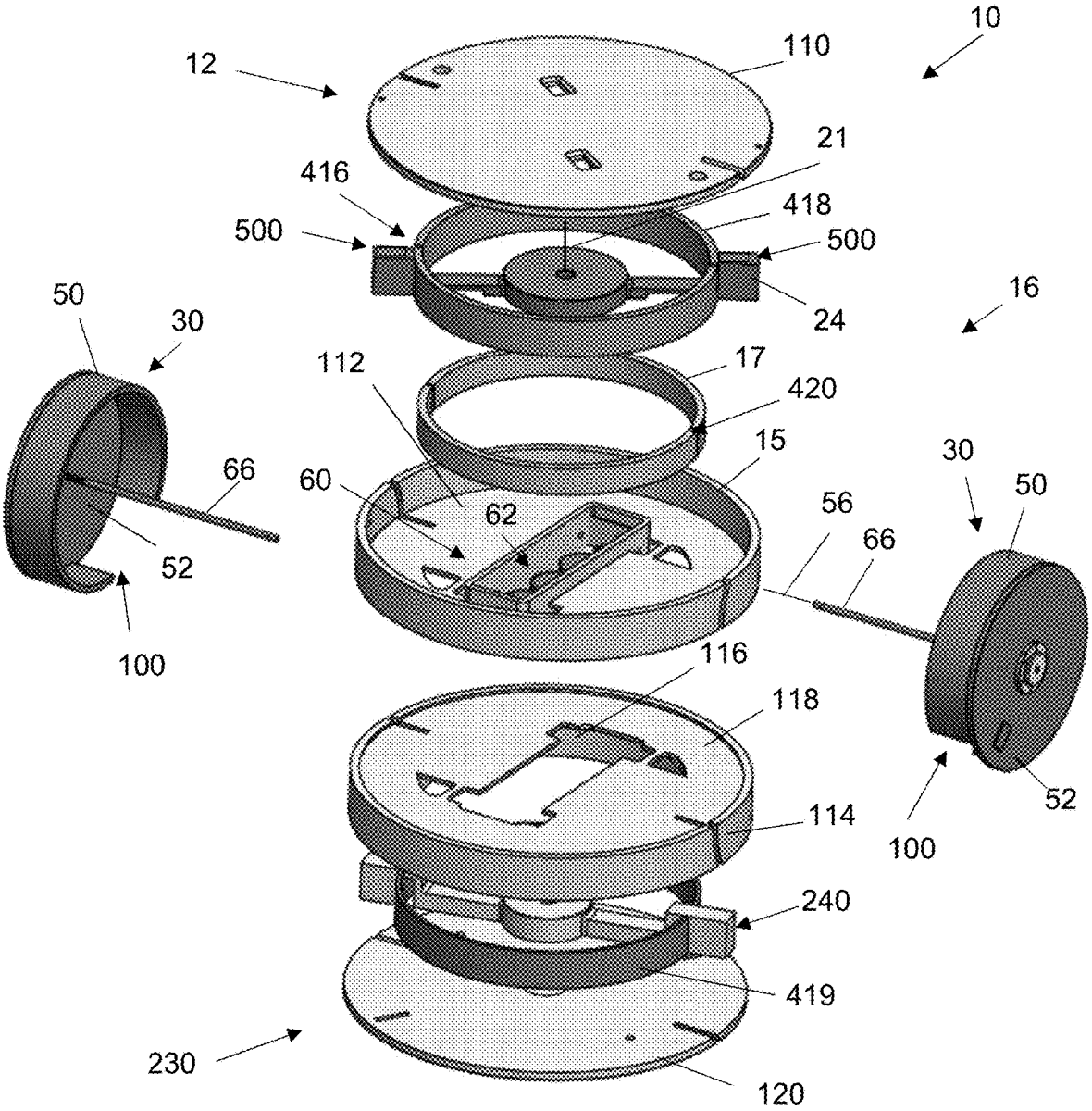
FIG. 2 illustrates an exploded view of a portion of the circulating piston engine of FIG. 1, according to one arrangement
Figure 4:
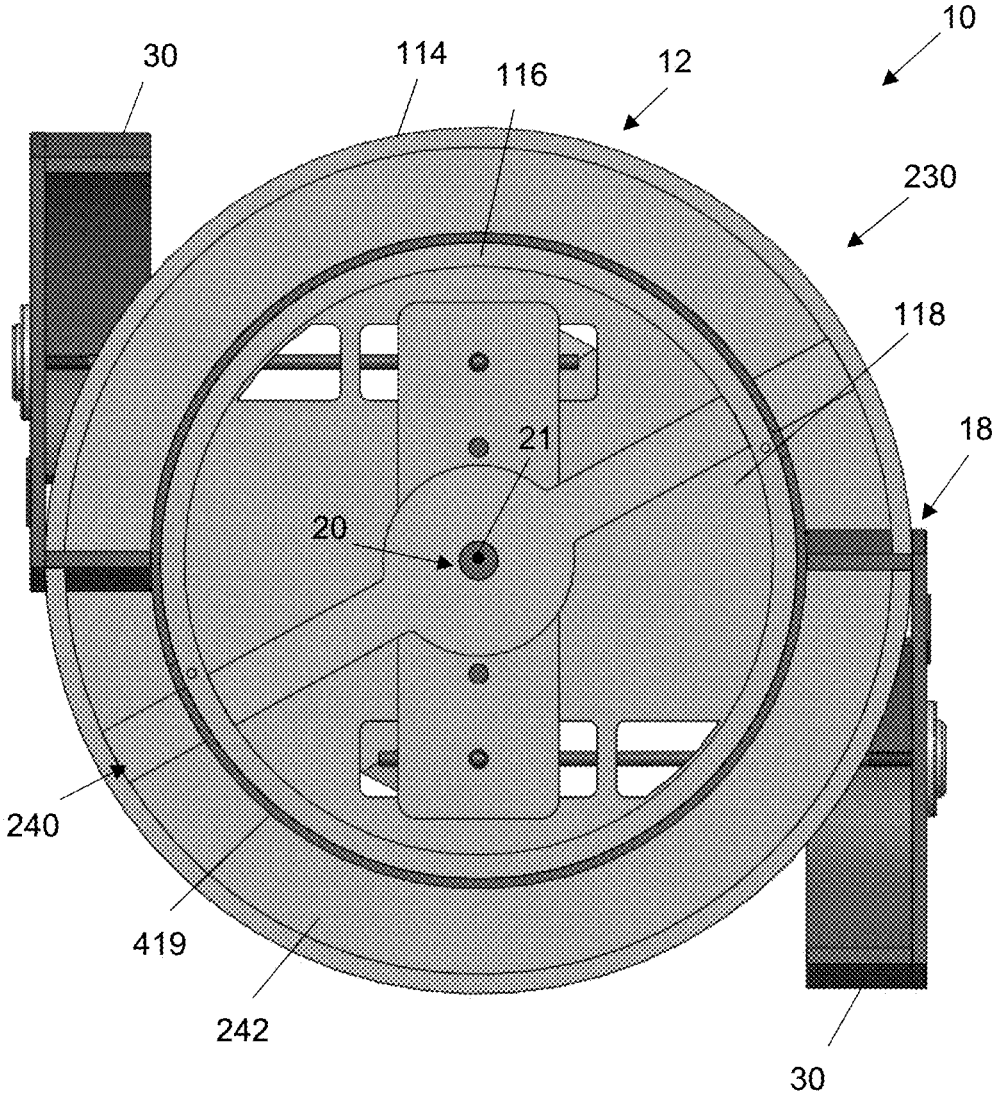
FIG. 4 illustrates a bottom sectional view of the circulating piston engine of FIG. 1, according to one arrangement.

During operation, and with reference to FIGS. 2-4, the exhaust gas generated by the engine 10 can undergo a change in temperature. For example, approximately one millisecond after ignition of an air-fuel mixture within a combustion chamber 26 (i.e., the volume between a rotary valve 30 and a piston 24), the temperature of the gas within the combustion chamber 26 can increase to approximately 4000° F. As the combustion piston 24 rotates within the annular bore 14 away from the rotary valve 30, the volume of the combustion chamber 26 increases until the combustion piston 24 reaches the next subsequently disposed rotary valve 30. As the volume of the combustion chamber 26 increases, the temperature of the combustion gas within the combustion chamber 26 decreases. For example, as the volume of the combustion chamber 26 doubles, the temperature of the gas within the combustion chamber 26 can decrease by one-half. Accordingly, following combustion, as the combustion piston 24 travels away from the rotary valve 30, the temperature of the gas within the combustion chamber 26 can decrease from approximately 4000° F. to approximately room temperature (e.g., between about 68° F. and 72° F.). With such a change in temperature, the engine 10 can be configured to utilize the relatively low temperature gas to reduce the temperature of a portion of the engine 10 or to utilize the relatively high temperature gas to raise the temperature of a portion of the engine 10.

Figure 13:
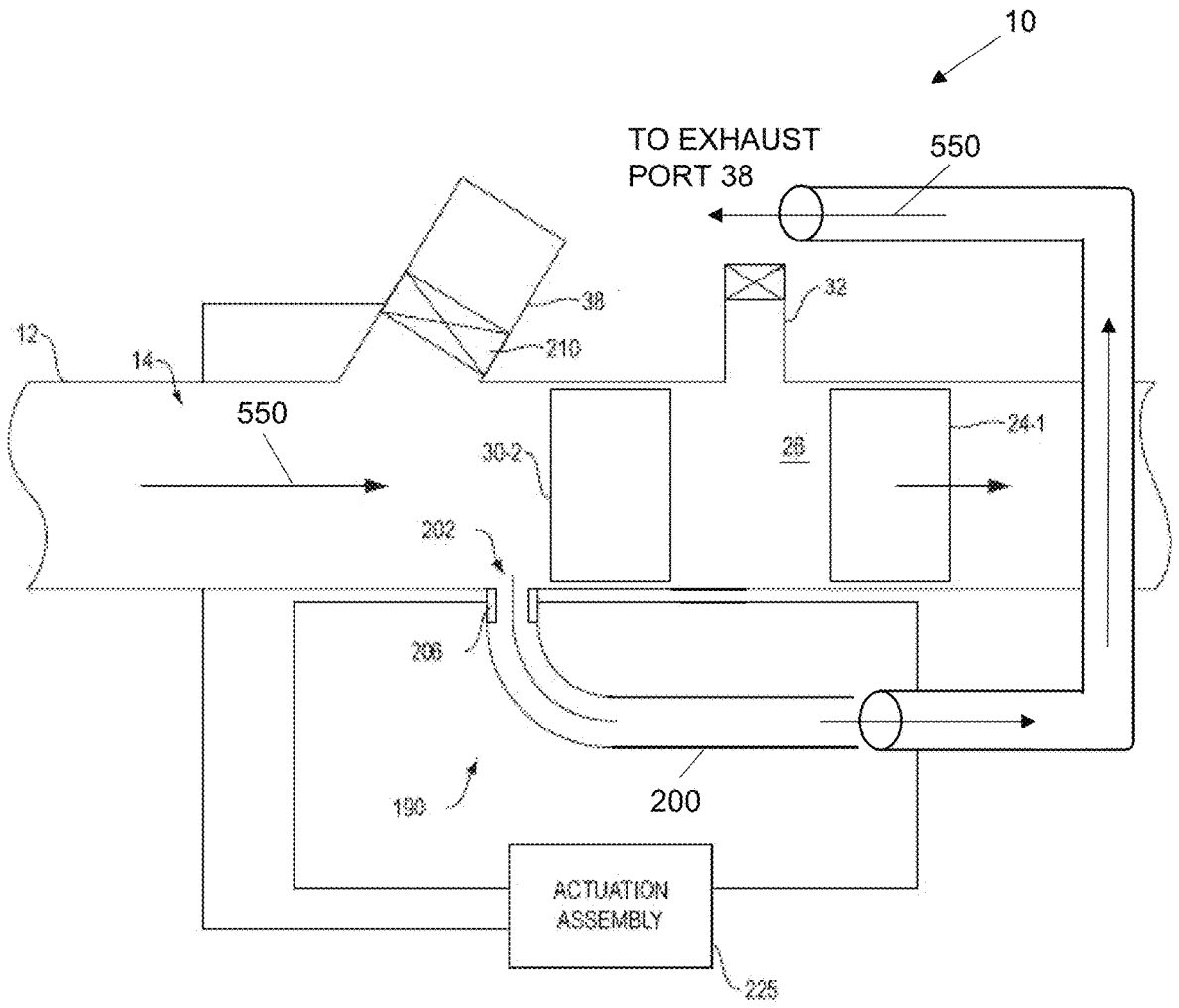
FIG. 13 illustrates a schematic side sectional view of a thermal redirection assembly of the circulating piston engine of FIG. 1, according to one arrangement.

In one arrangement, with reference to FIG. 13, the engine 10 includes a thermal redirection assembly 190 configured to direct relatively low temperature combustion gas 550 toward a relatively high temperature zone in the engine 10, such as near a combustion location.

For example, the thermal redirection assembly 190 includes a port 202 defined by the housing 12 and disposed on a first, proximal side of a rotary valve 30. The port 202 includes a port valve 206 which is disposable between an open position, as illustrated, and a closed position. Further, the thermal redirection assembly 190 includes a channel 200 disposed in fluid communication with the first port 202. The thermal redirection assembly 190 also includes an exhaust port valve 210 associated with a corresponding exhaust port 38 which is configured to be disposed between an open position (not shown) and a closed position. In one arrangement, each of the valves 206, 210 can be actuated (e.g., opened or closed) either an electronic or manual valve actuation assembly 225.

During operation, as relatively low temperature combustion gas 550 approaches the rotary valve 30-2, the actuation assembly 225 can dispose the exhaust valve 210 in a closed position and the port valve 206 in an open position, as shown. As such, as the combustion gas 550 approaches the rotary valve 30-2, the thermal redirection assembly 190 directs the combustion gas 550 into the channel 200. The channel 200, in turn, can direct the relatively low temperature combustion gas 550 past an area in the engine 10 having a relatively high temperature and toward an exhaust port 38, such as illustrated in FIG. 1. For example, the channel 200 can direct the combustion gas 550 through the engine housing towards a relatively high temperature location disposed in the vicinity of the combustion chamber 26. As such, during the point of peak temperature within a combustion chamber 26 (i.e., following ignition of the air-fuel mixture provided by the fuel injector 32), the combustion gas 550 can absorb heat from the engine housing 12 to reduce and regulate the temperature of the combustion chamber 26.

Figure 14:
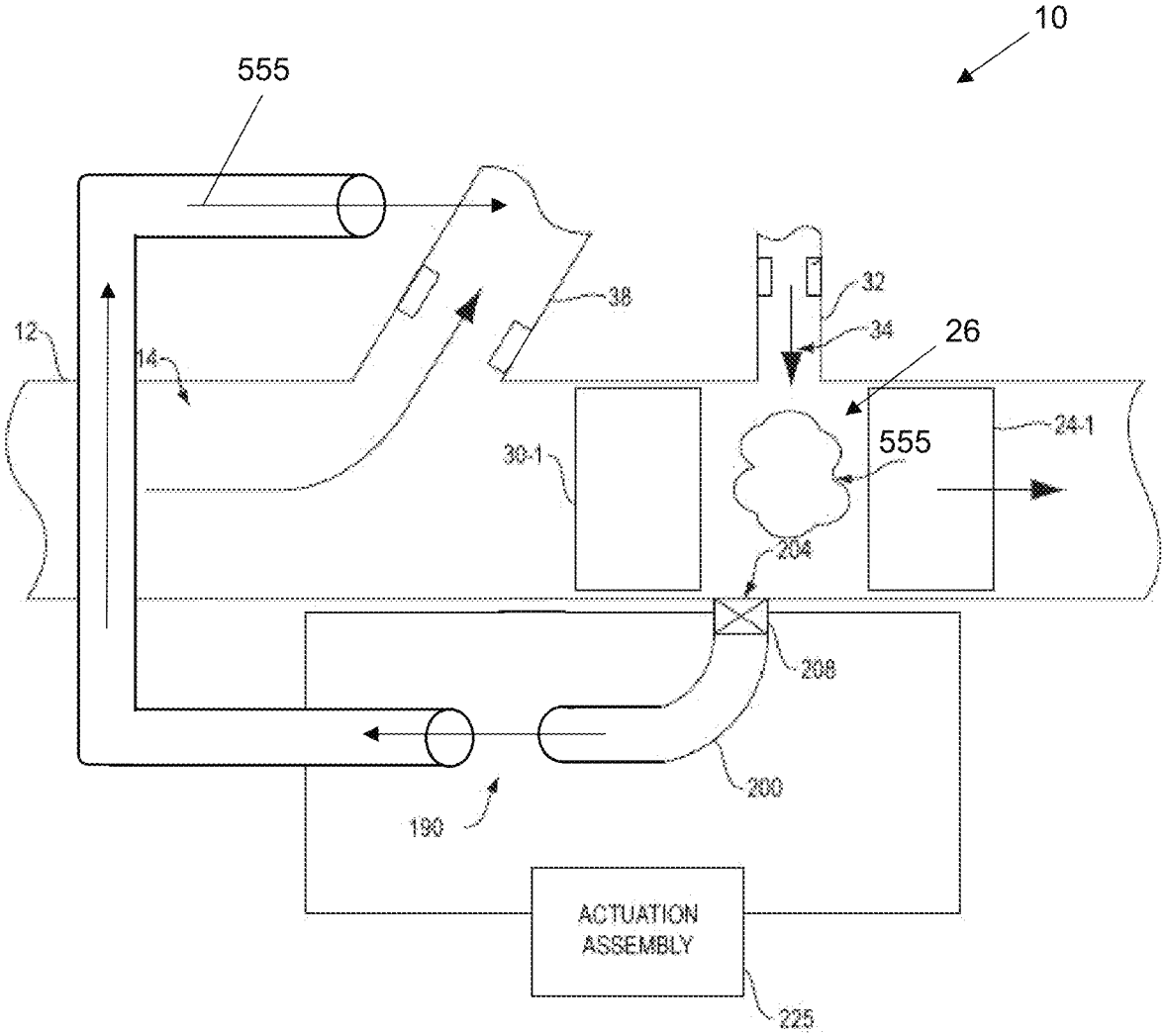
FIG. 14 illustrates a schematic side sectional view of a thermal redirection assembly of the circulating piston engine of FIG. 1, according to one arrangement.

As provided above, following ignition of an air-fuel mixture within a combustion chamber 26, the temperature of the gas within the combustion chamber 26 can increase to approximately 4000° F. The engine 10 can be configured to utilize the relatively high temperature gas to raise the temperature of a portion of the engine 10. In one arrangement, with reference to FIG. 14, the thermal redirection assembly 190 is configured to direct relatively high temperature combustion gas 555 toward a low temperature zone within the engine 10.

For example, the thermal redirection assembly 190 includes a second port 204 defined by the housing 12 and disposed on a second, distal side of the rotary valve 30-1. The second port 204 includes a second port valve 208 which is disposable between a first closed position, as shown in FIG. 13, and a second open position. Further, the thermal redirection assembly 190 includes a bypass channel 200 disposed in fluid communication with the second port 204.

During operation, ignition of the air-fuel mixture 34 provided by the fuel injector 32 generates relatively high temperature exhaust gas 555 within the combustion chamber 26. In response, actuation assembly 225 can dispose the second port valve 208 from the closed positon shown to an open position and the thermal redirection assembly 190 can direct the combustion gas 555 into the channel 200. The channel 200, in turn, can direct the relatively high temperature combustion gas 555 through an area in the engine 10 having a relatively low temperature and toward an exhaust port 38. For example, the channel 200 can direct the combustion gas 555 through the engine housing 12 towards a location disposed proximal to the rotary valve 30-1. As such, at the point of lowest temperature within the annular bore 14 (i.e., at the location proximal to the rotary valve 30), the combustion gas 550 can deliver heat to the engine housing 12 to aid in regulating the temperature of the bore 14.

Figure 15A:
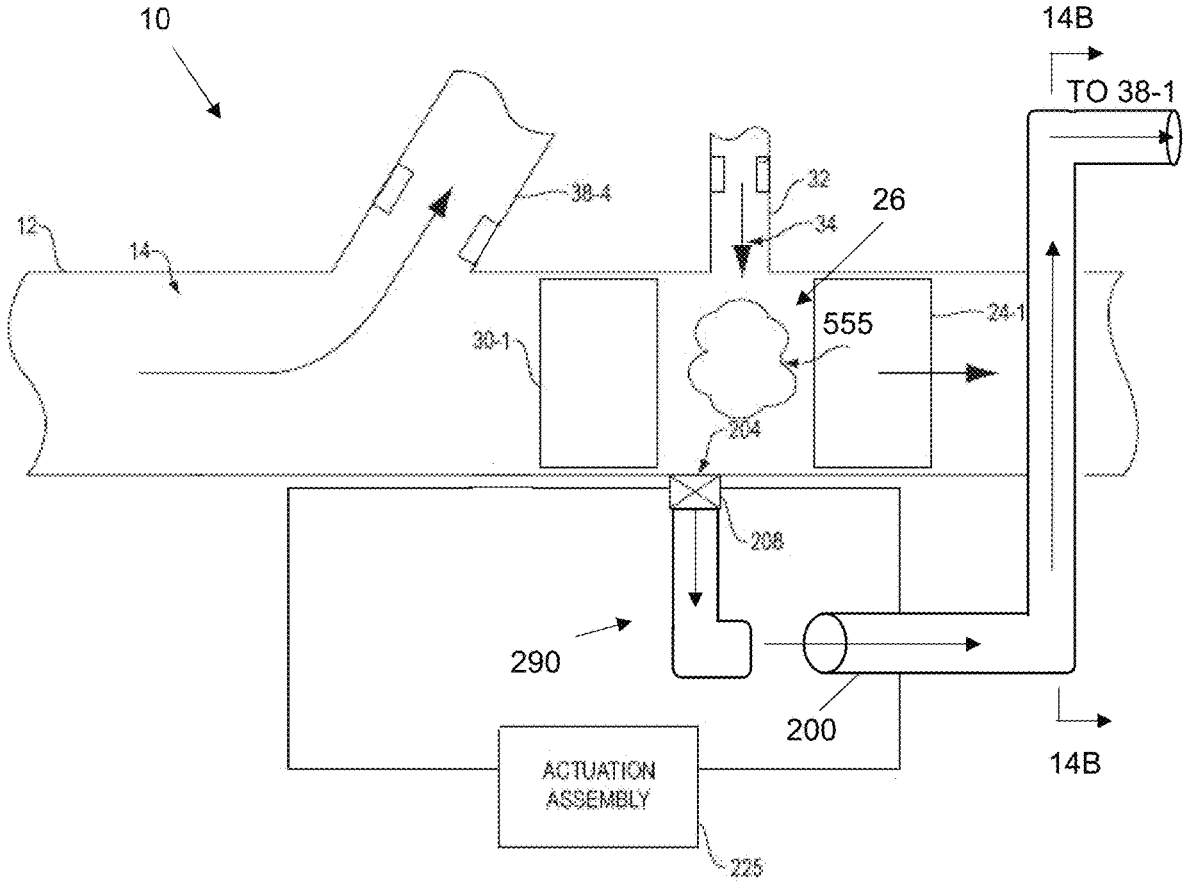
FIG. 15A illustrates a schematic side sectional view of a thermal redirection assembly of the circulating piston engine of FIG. 1, according to one arrangement.
Figure 15B:
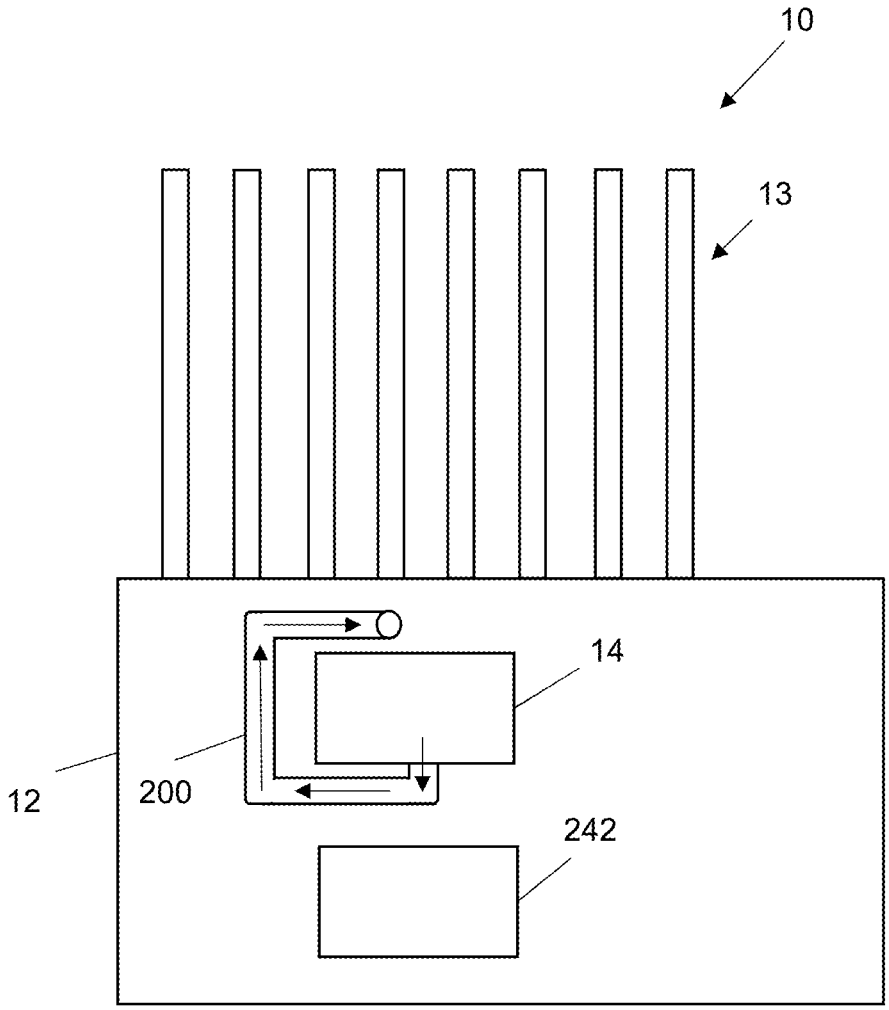
FIG. 15B illustrates a schematic front sectional view of the thermal redirection assembly of FIG. 15A, according to one arrangement.

In one arrangement, with reference to FIGS. 15A and 15B, the thermal redirection assembly 190 is configured to direct relatively high temperature combustion gas 555 along a length of the annular bore 14 within the engine 10.

As indicated in FIGS. 15A and 15B, the channel 200 is disposed within the engine housing 12 and outside of the annular channel 14. For example, as indicated in FIG. 15B, the channel 200 extends about a portion of a bottom, side, and top portions of the annular bore 14. Further, as indicated in FIG. 15A, the channel 200 extends along a length of the top portion of the annular bore 14 toward an exhaust port 38-1.

During operation, following ignition of the air-fuel mixture 34 provided by the fuel injector 32, as the combustion piston 24-1 translates within the annular bore 14, the volume of the combustion chamber 26 increases. Further, as the combustion gas 555 expands within the combustion chamber 26, the temperature of the combustion gas 555 can decrease, which can lead to a decrease in the temperature of the engine 10 along the length of the annular bore 14. In response, actuation assembly 225 can dispose the second port valve 208 in an open position and the gas transmission assembly 190 can direct the combustion gas 555 into the channel 200. By directing the relatively high temperature combustion gas 555 along the outside of the length of the annular bore 14 as the combustion piston 24-1 increases the volume of the combustion chamber 26, the thermal redirection assembly 190 can maintain the annular bore 14 and engine at a relatively high temperature, thereby maintaining the power output of the engine.

In one arrangement, the thermal redirection assembly 190 can utilize the relatively high temperature combustion gas 555 to heat the cabin of an automobile. For example, the thermal redirection assembly 190 can direct the combustion gas 555 past a heat exchange unit (not shown) and toward the exhaust port 38. The heat exchange unit can absorb the heat from the combustion gas 555 and can direct the heat toward an automobile cabin via one or more fans.

Returning to FIGS. 1-4, during a combustion process, the engine 10 can experience relatively large changes in temperature. For example, after the combustion of an air-fuel mixture the combustion chamber 26 and the walls of the annular bore 14 can experience a relatively high temperature followed by a decrease in temperature. Such a change in temperature can affect the mechanical properties of the engine 10. For example, for an engine manufactured from a metal or metal alloy material, an increase in temperature can cause the walls of the annular bore 14 to expand. Such expansion can create tolerance issues with the rotating combustion piston 24. Further, exposure to the relatively high temperatures during combustion can weaken the mechanical strength of the combustion piston 24 over time. In order to mitigate the effects of the combustion temperature, the engine 10 can include a thermal control system (not shown) which can be configured in a variety of ways.

In one arrangement, the thermal control system can include a thermally insulative material disposed in proximity to the walls within the annular bore 14. For example, the thermally insulative material can be a titanium material which can maintain heat from the air-fuel combustion within the bore 14. Further, titanium materials typically can include a relatively low coefficient of thermal expansion. Accordingly, exposure to the relatively large change in temperature during and following combustion of the air-fuel mixture can mitigate expansion of walls of the annular bore 14, thereby reducing tolerance issues relative to a rotating combustion piston 24.

In one arrangement, the thermal control system can include a ceramic material, such as a ceramic insert disposed within the annular bore 14. The ceramic material is configured to insulate the engine housing 12 from the heat generated within the annular bore 14 and to mitigate expansion of walls of the annular bore 14. Alternately, the thermal control system can include a ceramic material impregnated within the engine housing, such as in the location of the walls of the annular channel.

In one arrangement, the thermal control system can include a ceramic material coupled to the combustion piston 24, such as on a combustion-opposing face of the combustion piston 24. Use of the ceramic material with the piston in this manner can mitigate the piston's exposure to the relatively high temperatures during combustion. As such, the ceramic material can aid in maintaining the mechanical strength of the combustion piston 24 over time.

While various embodiments of the innovation have been particularly shown and described, it will be understood by those skilled in the art that various changes in form and details may be made therein without departing from the spirit and scope of the innovation as defined by the appended claims.

What is claimed is:

1. An engine, comprising:

a housing;

a combustion assembly carried by the housing, the combustion assembly comprising:

an annular bore defined by the housing, at least one combustion piston disposed within the annular bore, and a sealing mechanism positionable between a retracted position and an extended position relative to the at least one combustion piston and configured to selectively seal the at least one combustion piston relative to at least one corresponding wall of the annular bore; and at least one rotary valve configured to move between a first position within the annular bore to allow the at least one combustion piston to travel within the annular bore from a first location proximate to the at least one valve to a second location distal to the at least one rotary valve and a second position within the annular bore to define a combustion chamber relative to the at least one combustion piston at the second location.

2. The engine of claim 1, wherein the sealing mechanism comprises:

a combustion fluid channel defined by the at least one combustion piston and extending from a first face of the at least one combustion piston toward a second face of the at least one combustion piston, the combustion fluid channel configured to collect combustion gas within the annular bore defined by the housing;

at least one combustion valve channel disposed in fluid communication with the combustion fluid channel and extending between the combustion fluid channel and one of a vertical face of the combustion piston and a lateral face of the combustion piston; and a combustion piston valve disposed within the at least one combustion valve channel and positionable between the retracted position in the absence of a pressurized combustion gas within the combustion chamber and the extended position in the presence of a pressurized combustion gas within the combustion chamber, the combustion piston valve configured to contact a corresponding wall of the annular bore in the extended position.

3. The engine of claim 2, wherein the combustion piston valve comprises a material configured to limit friction between the at least one combustion piston and the corresponding wall of the annular bore.

4. The engine of claim 2, wherein:

the combustion piston valve comprises a first sidewall and a second side wall, each of the first sidewall and second sidewall defining a tapered geometry from a first end of the combustion piston valve toward a second end of the combustion piston valve; and the at least one combustion valve channel defines a slot having a first angled sidewall and a second angled sidewall, the first sidewall and the second side wall of the combustion piston valve configured to engage the corresponding first angled sidewall and second angled sidewall of the corresponding slot such that a portion of the second end of the combustion piston valve extends past the one of the vertical face of the combustion piston and the lateral face of the combustion piston.

5. The engine of claim 2 wherein, at least one combustion valve channel extends along a direction perpendicular to a longitudinal axis of the combustion fluid channel.

6. The engine of claim 2, wherein:

the at least one combustion valve channel extending between the combustion fluid channel and one of the vertical face of the combustion piston and the lateral face of the combustion piston comprises:

a first combustion valve channel disposed in fluid communication with the combustion fluid channel and extending between the combustion fluid channel and a first lateral face of the combustion piston, a second combustion valve channel disposed in fluid communication with the combustion fluid channel and extending between the combustion fluid channel and a second lateral face of the combustion piston, and a third combustion valve channel disposed in fluid communication with the combustion fluid channel and extending between the combustion fluid channel and a vertical face of the combustion piston; and the combustion piston valve disposed within the at least one valve channel comprises:

a first combustion piston valve disposed within the first combustion valve channel, a second combustion piston valve disposed within the second combustion valve channel, and a third combustion piston valve disposed within the third combustion valve channel.

7. The engine of claim 6, comprising a combustion piston sealing ring connected to each combustion piston of the combustion assembly, the combustion piston sealing ring configured to mitigate the flow of combustion gas past the at least one combustion piston of the combustion assembly along a direction of rotation of the at least one combustion piston.

8. The engine of claim 1, further comprising a compression assembly carried by the engine, the compression assembly comprising:

an annular compression channel defined by the housing, the annular compression channel disposed substantially parallel to the annular bore defined by the housing;

at least one compression piston disposed within the annular compression channel; and a sealing mechanism configured to selectively seal the at least one compression piston relative to at least one corresponding wall of the annular compression channel.

9. The engine of claim 8, wherein the sealing mechanism comprises:

a compression fluid channel defined by the at least one compression piston and extending from a second face of the at least one compression piston toward a first face of the at least one compression piston, the compression fluid channel configured to collect pressurized gas within the annular compression channel defined by the housing;

at least one compression valve channel extending between the compression fluid channel and one of a vertical face of the compression piston and a lateral face of the compression piston; and a compression piston valve disposed within the at least one compression valve channel in a retracted position in the absence of a pressurized gas within the annular compression channel and in an extended position in contact with a corresponding wall of the annular compression channel in the presence of a pressurized gas within the annular compression channel.

10. The engine of claim 9, wherein the compression piston valve comprises a material configured to limit friction between the at least one compression piston and the corresponding wall of the annular compression channel.

11. The engine of claim 9, wherein:

the compression piston valve comprises a first sidewall and a second side wall, each of the first sidewall and second sidewall defining a tapered geometry from a first end of the compression piston valve toward a second end of the compression piston valve; and the at least one compression valve channel defines a slot having a first angled sidewall and a second angled sidewall, the first sidewall and a second side wall of the compression piston valve configured to engage the corresponding first angled sidewall and second angled sidewall of the at least one compression valve channel such that a portion of the second end of the compression piston valve extends past the one of the vertical face of the compression piston and the lateral face of the compression piston.

12. The engine of claim 9, wherein at least one compression valve channel extends along a direction perpendicular to a longitudinal axis of the compression fluid channel.

13. The engine of claim 9, wherein:

the at least one compression valve channel extending between the fluid channel and one of the vertical face of the compression piston and the lateral face of the compression piston comprises:

a first compression valve channel disposed in fluid communication with the compression fluid channel and extending between the compression fluid channel and a first lateral face of the compression piston, a second compression valve channel disposed in fluid communication with the compression fluid channel and extending between the compression fluid channel and a second lateral face of the compression piston, and a third compression valve channel disposed in fluid communication with the compression fluid channel and extending between the compression fluid channel and a vertical face of the compression piston; and the compression piston valve disposed within the at least one compression valve channel comprises:

a first compression piston valve disposed within the first compression valve channel, a second compression piston valve disposed within the second compression valve channel, and a third compression piston valve disposed within the third compression valve channel.

14. The engine of claim 8, comprising a compression piston sealing ring connected to each compression piston of the set of compression pistons, the compression piston sealing ring configured to mitigate the flow of pressurized gas within the annular compression channel past the at least one compression piston of the compression assembly along a direction opposing rotation of the at least one compression piston.

15. The engine of claim 1, comprising an air-fuel distribution assembly configured to mix fuel from a fuel source and air from an air source into an air-fuel mixture at a location external to the combustion chamber and to deliver the air-fuel mixture to the combustion chamber.

16. The engine of claim 15, wherein the air-fuel distribution assembly comprises:

a housing having an inlet port, an outlet port and defining a chamber disposed there between, the inlet port configured to be disposed in fluid communication with a pressurized air reservoir and the outlet port configured to be disposed in fluid communication with the combustion chamber;

a laminar flow device coupled to the housing and disposed in proximity to the inlet port, the laminar flow device configured to control at least one of a distribution, shape, and velocity of pressurized air provided through the inlet port; and a set of fuel injectors coupled to the housing and disposed in proximity to the laminar flow device.

17. The engine of claim 16, further comprising an air-fuel volume control device disposed in fluid communication between the chamber and the outlet port, the air-fuel volume control device configured to meter distribution of the air-fuel mixture contained within the chamber to the outlet port.

18. The engine of claim 1, comprising a thermal redirection assembly configured to direct combustion gas generated within the combustion assembly toward a relatively high temperature zone in the engine.

19. The engine of claim 1, comprising a thermal redirection assembly configured to direct combustion gas generated within the combustion assembly toward a relatively low temperature zone in the engine.

* * * * *